US010122098B2

(12) United States Patent
Bozkaya et al.

(10) Patent No.: US 10,122,098 B2
(45) Date of Patent: Nov. 6, 2018

(54) TRANSFORMER TERMINAL COUPLER IN CLOSE PROXIMITY TO A DISTRIBUTION TRANSFORMER FOR CONNECTING AT LEAST ONE ELECTRICAL DEVICE TO ONE OR MORE LOADS

(71) Applicant: Gridco, Inc., Woburn, MA (US)

(72) Inventors: Dincer Bozkaya, Frmaingham, MA (US); Harry Fairbrother, Danville, NH (US); Eric Peterson, Carlisle, MA (US)

(73) Assignee: Varentec, Inc., Santa Clara, CA (US)

( * ) Notice: Subject to any disclaimer, the term of this patent is extended or adjusted under 35 U.S.C. 154(b) by 28 days.

(21) Appl. No.: 15/475,498

(22) Filed: Mar. 31, 2017

(65) Prior Publication Data

US 2017/0288324 A1 Oct. 5, 2017

Related U.S. Application Data

(60) Provisional application No. 62/317,016, filed on Apr. 1, 2016.

(51) Int. Cl.
*H01R 9/24* (2006.01)
*H01F 27/29* (2006.01)

(52) U.S. Cl.
CPC ..... *H01R 9/24* (2013.01); *H01F 27/29* (2013.01)

(58) Field of Classification Search
CPC ..... H01R 11/07; H01R 11/09
USPC ..... 439/798, 797, 921, 957
See application file for complete search history.

(56) References Cited

U.S. PATENT DOCUMENTS 4,456,326 A * 6/1984 Sauber ..... H01R 4/66 439/540.1
4,547,627 A * 10/1985 McGrane ..... H02G 15/12 174/138 F
4,800,732 A * 1/1989 Newton ..... F25B 31/02 310/71
5,931,708 A * 8/1999 Annas ..... H01R 4/36 439/724
6,347,967 B1 * 2/2002 Tamm ..... H01R 4/40 403/322.1
6,368,162 B1 * 4/2002 Reetz ..... H01R 4/36 439/723
6,676,454 B2 * 1/2004 De France ..... H01R 4/42 439/781
6,709,287 B2 * 3/2004 Sims ..... B60L 11/1816 200/296
6,769,941 B2 * 8/2004 Norden ..... H01R 4/38 439/797
6,971,926 B1 * 12/2005 Walton ..... H01R 11/12 439/798
7,014,514 B2 * 3/2006 Zahnen ..... H01R 4/36 439/798

(Continued)

*Primary Examiner* — Neil Abrams
(74) *Attorney, Agent, or Firm* — Sheppard Mullin Richter & Hampton LLP

(57) ABSTRACT

A transformer terminal coupler in close proximity to a distribution transformer for connecting at least one electrical device to one or more loads includes at least one connection point device electrically isolated from the distribution transformer and physically secured in close proximity to a low voltage output of the distribution transformer. The at least one connection point device is configured to secure electrical coupling of the at least one electrical device to the one or more loads.

65 Claims, 15 Drawing Sheets

(56) References Cited

U.S. PATENT DOCUMENTS

| | | | | |
|---|---|---|---|---|
| 7,175,484 | B1 * | 2/2007 | Tamm | H01R 4/40 439/798 |
| 7,311,564 | B2 * | 12/2007 | Zahnen | H01R 4/36 439/798 |
| 8,425,264 | B2 * | 4/2013 | Michell | H01R 4/42 439/789 |
| 8,647,159 | B2 * | 2/2014 | Steeves | H01R 4/305 439/798 |
| 8,801,475 | B2 * | 8/2014 | Maninchedda | H01R 4/36 439/814 |
| 2005/0202732 | A1 * | 9/2005 | Rizzo | H01R 4/36 439/810 |
| 2009/0163087 | A1 * | 6/2009 | Sweeney | H01R 4/26 439/798 |
| 2011/0237140 | A1 * | 9/2011 | Cerasale | H01R 4/36 439/797 |
| 2017/0288324 | A1 * | 10/2017 | Bozkaya | H01F 27/29 |

* cited by examiner

TRANSFORMER TERMINAL COUPLER IN CLOSE PROXIMITY TO A DISTRIBUTION TRANSFORMER FOR CONNECTING AT LEAST ONE ELECTRICAL DEVICE TO ONE OR MORE LOADS

RELATED APPLICATIONS

This application claims benefit of and priority to U.S. Provisional Application Ser. No. 62/317,016 filed Apr. 1, 2016, under 35 U.S.C. §§ 119, 120, 363, 365, and 37 C.F.R. § 1.55 and § 1.78, which is incorporated herein by this reference.

FIELD OF THE INVENTION

This invention relates to a transformer terminal coupler secured in close proximity of a distribution transformer for connecting at least one electrical device to one or more loads.

BACKGROUND OF THE INVENTION

In the electrical grid, electricity is distributed to loads, such as homes in a residential neighborhood, commercial and industrial facilities, and the like, at medium voltages (MV) before the MV is stepped down to low voltage (LV) in close proximity to the load. A distribution transformer is typically used to provide step down of voltage from MV to LV. The LV output of the transformer is connected to the one or more loads. An electrical connection between the transformer and the one or more loads is established by conductors, which may be underground or overhead depending on the type of distribution system. A typical distribution transformer may be connected to a single load up to 12 or more loads depending on the size of transformer. If a split phase distribution transformer is used, the number of load connections may be thirty-six or more, e.g., twelve loads or more, each having three connections per load.

To address various challenges related to the electrical grid, different types of electrical devices may be inserted between the distribution transformer and the one or more loads. For example, in-line electrical devices, such as in-line power regulators or in-line impedances use an electrical connection between the transformer and the one or more loads which is routed through the electrical device. In this example, the LV output of transformer is connected to the source side of the electrical device and load side of the electrical device is then connected to the one or more loads. If a generator or other energy sources, such as batteries is connected to the distribution transformer, the LV output of distribution transformer is disconnected from the one or more loads and the one or more loads is connected directly to the electrical device. A switch can be used to alternate the connection between the transformer and electrical device.

To connect the electrical device to the distribution transformer and the one or more loads, reconstructing wires or conductors connecting to the one or more loads can often be cost prohibitive, especially for an underground distribution system. Additionally, the cost further increases with higher number of loads. One cost effective, and less disruptive, technique to insert the electrical device between the one or more loads and the distribution transformer is to use the existing conductors between the distribution transformer and the one or more loads. This may be achieved by breaking the electrical connection between the distribution transformer and the one or more loads and providing electrical connections from the electrical device to the distribution transformer and to the one or more loads in close proximity to the transformer.

In this example, the load connections at the LV outputs of transformer are disconnected and the load connections are coupled to the electrical device. This requires splicing of one or more conductors, depending on the number of loads to the conductor, and establishing the electrical connection to the electrical device. Different types of conventional splicing devices are known to form an electrical bond between multiple conductors while providing protection against water and other environmental factors. In the example of underground distribution system, a commonly used splicing device is a submersible secondary distribution connector which includes a rubber coated boot and a set screw terminal block with multiple ports to accept multiple conductors and electrically bond them together.

There are several shortcomings associated the method of connecting the electrical device to one or more loads discussed above. In order to utilize the conventional splicing devices, the connections between load conductors and distribution transformer need to be removed. The load conductors are then cut back to proper length so that conductors can be terminated at the new splicing device which may result in long installation times. Moreover, this operation typically requires the distribution transformer to be de-energized, which results in a disruption of service to the one or more loads during installation time. In addition to installation time, new connectors are also needed which further increases costs. The new terminal to accept multiple conductors and electrically bond them together, e.g., a submersible secondary distribution connector, is typically located in a buried space below the transformer terminals. There is no convenient way of physically securing the terminal to the distribution transformer. This may make it difficult to service the new connections due to limited access and visibility of the connections as each connection is now covered with a rubber boot and located near or below ground level and is not physically secured. Having the electrical connections located at or below ground level may create a risk for reliability of the connections due to exposure to water, rodents and other environmental factors. This type of connection may also make it difficult to restore the original connection between the distribution transformer and the one or more loads if the electrical device needs to be taken out of service.

Thus, there is a need for a simple and cost effective transformer coupler secured in close proximity to a distribution transformer to connect at least one electrical device to one or more loads.

BRIEF SUMMARY OF THE INVENTION

In one aspect, a transformer terminal coupler in close proximity to a distribution transformer for connecting at least one electrical device to one or more loads is featured. The transformer terminal coupler includes at least one connection point device electrically isolated from the distribution transformer and physically secured in close proximity to a low voltage output of the distribution transformer. The at least one connection point device is configured to secure electrical coupling of the at least one electrical device to the one or more loads.

In one embodiment, the at least one connection point device may be configured to secure electrical coupling of a load side of the at least one electrical device to the one or more loads. The at least one connection point device may be configured to mate with a stud-mounted terminal connector. The stud-mounted terminal connector may be previously coupled to at least one of the one or more loads. The stud-mounted terminal connector may include an open port that enables the at least one connection point device to secure electrical coupling of the at least one electrical device to the one or more loads. The at least one connection point device may include a stud configured to mate with the stud-mounted terminal connector. The stud may be configured to have a compatible size of a stud of a low voltage bushing of the distribution transformer. The stud may be configured to have the same diameter and threads of the same pitch as the stud of the low voltage bushing of the distribution transformer. The at least one connection point device may include a lug connector. The stud-mounted terminal connector may include a slip-fit stud-mounted terminal connector. The stud-mounted terminal connector may include a threaded stud-mounted terminal connector. The stud-mounted terminal connector may include a set screw. The stud-mounted terminal connector may include a spade stud-mounted terminal connector. The at least one connection point device may be configured to couple directly with at least one load. The connection point device may include a conductor block with at least one opening therein that enables the at least one connection point device to secure electrical coupling of the at least one electrical device to the one or more loads. The connector block may include at least one set screw. The transformer terminal coupler may include an insulator physically coupled to the at least one connection point device and configured to electrically isolate the at least one connection point device from the distribution transformer. The insulator may be secured to an outside of the distribution transformer. The insulator may be secured to at least one low voltage output of the distribution transformer. The transformer terminal coupler may include a bracket coupled to the distribution transformer configured to secure the insulator to the distribution transformer. The insulator may be configured as a plate of insulation material. The plate of insulation material may include at least one opening. A stud of a low voltage bushing of the distribution transformer may extend through an opening of the plate of insulation material. The plate of insulation material may include at least one slotted opening. The insulator may be configured as a block of insulation material. The transformer terminal coupler may include a distribution transformer connector configured to couple the at least one low voltage output of the distribution transformer to the at least one electrical device. The distribution transformer connector may be configured to couple the at least one low voltage output of the distribution transformer to a source-side of the at least one electrical device. The distribution transformer connector may include a stud-mounted terminal connector configured to mate with a stud of a low voltage bushing of the distribution transformer. The stud-mounted terminal connector may include a slip-fit stud-mounted terminal connector. The stud-mounted terminal connector may include a threaded stud-mounted terminal connector. The stud-mounted terminal connector may include a set screw. The stud-mounted terminal connector may include a spade stud-mounted terminal connector. The at least one electrical device may include one or more of: an in-line power regulator, an in-line voltage regulator, a switch, an in-line impedance, and a generator. The at least one connection point device may be configured to mate with a stud-mounted terminal connector. The transformer terminal coupler may include a distribution transformer connector configured to couple at least one low voltage output of the distribution transformer to the at least one electrical device. The distribution transformer connector may include a spade stud-mounted terminal connector. The at least one connection point device may be configured to couple directly with at least one load. The at least one connection point device may include a conductor block with at least one opening therein that enables the at least one connection point device to secure electrical coupling of the at least one electrical device to the one or more loads. The spade stud-mounted terminal connector may include at least one opening configured to couple the low voltage output of the distribution transformer to a source side of the at least one electrical device.

In another aspect a transformer terminal coupler in close proximity to a distribution transformer for connecting at least one electrical device to one or more loads is featured. The transformer terminal coupler includes at least one connection point device configured to mate with a stud-mounted terminal connector. The at least one connection point device is electrically isolated from the distribution transformer and physically secured in close proximity to a low voltage output of the distribution transformer. An insulator physically coupled to the at least one connection point device is configured to electrically isolate the at least one connection point device from the distribution transformer. The at least one connection point device is configured to secure electrical coupling of the at least one electrical device to the one or more loads.

In another aspect, a transformer terminal coupler in close proximity to a distribution transformer for connecting at least one electrical device to one or more loads is featured. The transformer terminal coupler includes at least one connection point device electrically isolated from the distribution transformer and physically secured in close proximity to a low voltage output of the distribution transformer. An insulator physically coupled to the at least one connection point device is configured to electrically isolate the at least one connection point device from the distribution transformer. A distribution transformer connector coupled to the insulator is configured to couple the at least one low voltage output of the distribution transformer to a source-side of the at least one electrical device. The at least one connection point device is configured to secure electrical coupling of the at least one electrical device to the one or more loads.

In yet another aspect, a transformer terminal coupler in close proximity to a distribution transformer for connecting at least one electrical device to one or more loads is featured. The transformer terminal coupler includes at least one connection point device electrically isolated from the distribution transformer and physically secured in close proximity to a low voltage output of the distribution transformer. An insulator physically is coupled between the at least one connection point device and a spade stud-mounted terminal connector coupled to the low voltage output of the distribution transformer. The insulator is configured to electrically isolate the at least one connection point device from the distribution transformer. The at least one connection point device includes a conductor block coupled to the insulator with at least one opening therein configured to secure electrical coupling of the at least one electrical device to the one or more loads device, the spade stud-mounted terminal connector including at least one opening is configured to couple the low voltage output of the distribution transformer to a source-side of the at least one electrical device.

In another aspect, a transformer terminal coupler in close proximity to a distribution transformer for connecting at least one electrical device to one or more loads is featured. The transformer terminal coupler includes a plurality of connection point devices each electrically isolated from the distribution transformer and each physically secured in close proximity to a low voltage output of the distribution transformer. Each of the plurality of connection point devices is configured to secure electrical coupling of the at least one electrical device to the one or more loads.

In one embodiment, each of the plurality of connection point devices may be configured to connect a load side of the at least one electrical device to one or more loads. Each of the plurality of connection point devices may be configured to mate with a stud-mounted terminal connector. The stud-mounted terminal connector may be previously coupled to at least one of the one or more loads. The stud-mounted terminal connector may include an open port that enables the at least one connection point device to secure electrical coupling of the at least one electrical device to the one or more loads. Each of the plurality of connection point devices may include a stud configured to mate with a stud-mounted terminal connector. Each stud may be configured to have a compatible size of a stud of a low voltage bushing of the distribution transformer. Each stud may be configured to have a same diameter and threads of the same pitch as the stud of the low voltage bushing of the distribution transformer. At least one of the plurality of connection point devices may include a lug connector. The transformer terminal coupler may include an insulator physically coupled to the plurality of connection point devices and configured to electrically isolate the plurality of connection point devices from the distribution transformer. The insulator may be secured to an outside of the distribution transformer. The insulator may be secured to the plurality of connection point devices and a plurality of low voltage outputs of the distribution transformer. The transformer terminal coupler may include a bracket coupled to the distribution transformer configured to secure the insulator to the distribution transformer. The insulator may be configured as a plate of insulation material. The plate of insulation material may include a plurality of openings. The studs of low voltage bushings of the distribution transformer may extend through the openings. The plurality of openings may include at least one slotted opening. The transformer terminal coupler may include a plurality of distribution transformer connectors each configured to couple a low voltage output of the distribution transformer to the at least one electrical device. Each of the plurality of distribution transformer connectors may be configured to couple a low voltage output of the distribution transformer to a source-side of the at least one electrical device. Each of the plurality of distribution transformer connectors may include a stud-mounted terminal connector configured to mate with a stud of a low voltage bushing of the distribution transformer. The at least one electrical device may include one or more of: an in-line power regulator, an in-line voltage regulator, a switch, an in-line impedance, and a generator. Each of the plurality of connector point devices may be configured to mate with a stud-mounted terminal connector. The transformer terminal coupler may include a plurality of distribution transformer connectors each configured to couple a low voltage output of the distribution transformer to the at least one electrical device.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
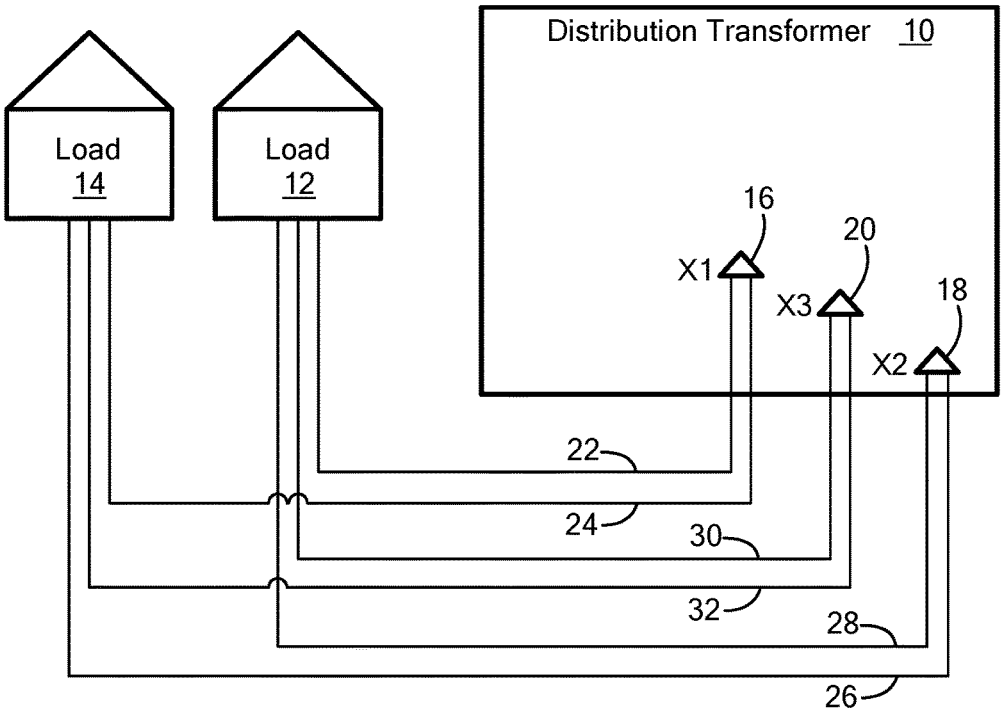
FIG. 1 PRIOR ART
FIG. 1 is a schematic block diagram showing an example of a connection between a distribution transformer and one or more loads before an electrical device is introduced.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

FIG. 1 shows a typical connection between distribution transformer 10 and one or more loads, in this example load 12 and/or load 14, e.g., homes in a residential neighborhood, commercial and industrial facilities, or similar type loads typically coupled to a distribution transformer. In this example, for simplification, only two loads are shown. As discussed in the Background section above, distribution transformer 10 may be connected to a single load or up to 12 or more loads depending on the size of transformer. If a split phase distribution transformer is used, the number of load connections may be thirty-six or more, e.g., twelve loads or more, each having three connections per load. In this example, distribution transformer 10 may be a single, split phase transformer with LV outputs X1-16, X2-18, and X3-18 as shown. In other examples, distribution transformer may be of the type to serve three phase loads and have at least three outputs. In this example, each of LV outputs X1-16, X2-18, and X3-20 are connected to loads 12 and 14 as shown. In this example, with two loads 12, 14, there would be two conductors 22, 24 for LV output X1-16, two conductors 26, 28 for LV output X2-18 and two conductors 30, 32 for LV output X3-20 for a total of six conductors between distribution transformer 10 and the one or more loads 12, 14 as shown.

Figure 2:
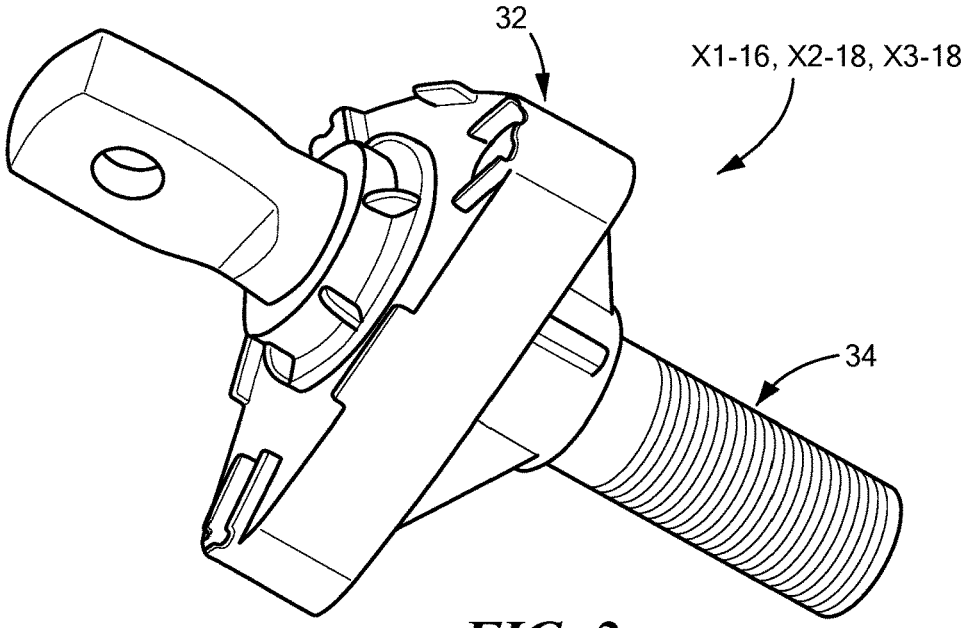
FIG. 2 PRIOR ART
FIG. 2 shows a three-dimensional front view showing an example of one of the LV bushings of the distribution transformer shown in FIG. 1.

Each of LV outputs of X-16, X2-18, and X3-20 of distribution transformer 10 is typically configured as a LV bushing. There are many types of LV bushings. A common type LV bushing typically used with LV outputs X-16, X2-18, and X3-20 of distribution transformer 10 includes a threaded stud as the connection point. FIG. 2 shows an example of a typical conventional LV bushing 32 with male threaded stud 34. A stud-mount terminal is typically used as a connector which physically attaches to threaded stud 34 of LV bushing 32 of each of LV outputs X-16, X2-18, and X3-20, FIG. 1, to electrically couple conductors 22-32 one or more loads 12, 14 to threaded stud 34, FIG. 2. Various types of stud-mount terminal connections may be used to electrically couple one or more load 12 and/or 14 to male threaded stud 34 of bushing 32 to enable different connections between multiple load conductors 22-32, FIG. 1, and the LV bushing, e.g., LV bushing 32, FIG. 2.

Figure 3:
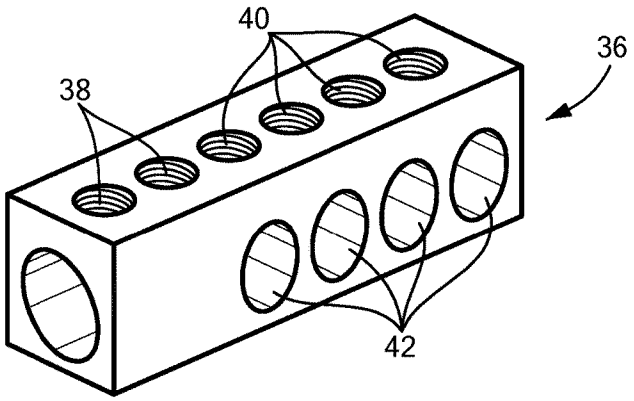
FIG. 3 PRIOR ART
FIG. 3 shows is a three-dimensional side view showing an example of a slip-fit stud-mounted terminal.

For example, slip-fit stud-mounted terminal connector 36, FIG. 3, may be used to electrically couple conductors 22-32, FIG. 1, coupled to one or more loads 12 and/or 14 to male threaded stud 34, FIG. 2, of LV bushing 32 of each of X1-16, X2-18, and X3-20, FIG. 1. In this example, slip-fit stud-mounted terminal connector 36, FIG. 3, is slipped over male threaded stud 34, FIG. 2, of each LV bushing of LV outputs X1-16, X2-18, and X3-20, FIG. 1, and set screws are screwed into one or more of female threaded openings 38, FIG. 3, to secure slip-fit stud-mounted terminal 36 to threaded stud 34, FIG. 2, 24 of LV busing 32 of each of LV outputs X1-16, X2-18, and X3-20. Screws are inserted into one or more of female threaded openings 40, FIG. 3, to secure load conductors 22-32, FIG. 1, which are inserted into the openings 42 of the slip-fit stud-mounted terminal connector 36, FIG. 3. In another example, a threaded spade stud-mounted terminal connector may be utilized to electrically couple conductors 22-32, FIG. 1, coupled to one or more loads 12 and/or 14 to threaded stud 34, FIG. 2, of LV bushing 32, e.g., any one of female threaded spade stud-mounted terminal connectors 44, FIG. 4. In this example, female threaded spade stud-mounted terminal connectors 44 are threaded over male threaded stud 34 of each LV bushing 32 of LV outputs X1-16, X2-18, and X3-20. The choice of a slip-fit stud-mounted terminal connector 36 or spade stud-mounted terminal connectors 44 is based on the physical attachment method desired to couple, conductors 22-32 to LV bushing 32 to LV outputs X1-16, X2-18, and X3-20.

When an electrical device, such as an in-line power regulator, an in-line voltage regulator, an impedance, a generator or similar type electrical device needs to be introduced to one or more loads, the load side and source side of the electrical device need to be connected to the one or more loads and the LV bushings of the LV outputs of the distribution transformer.

Figure 5:
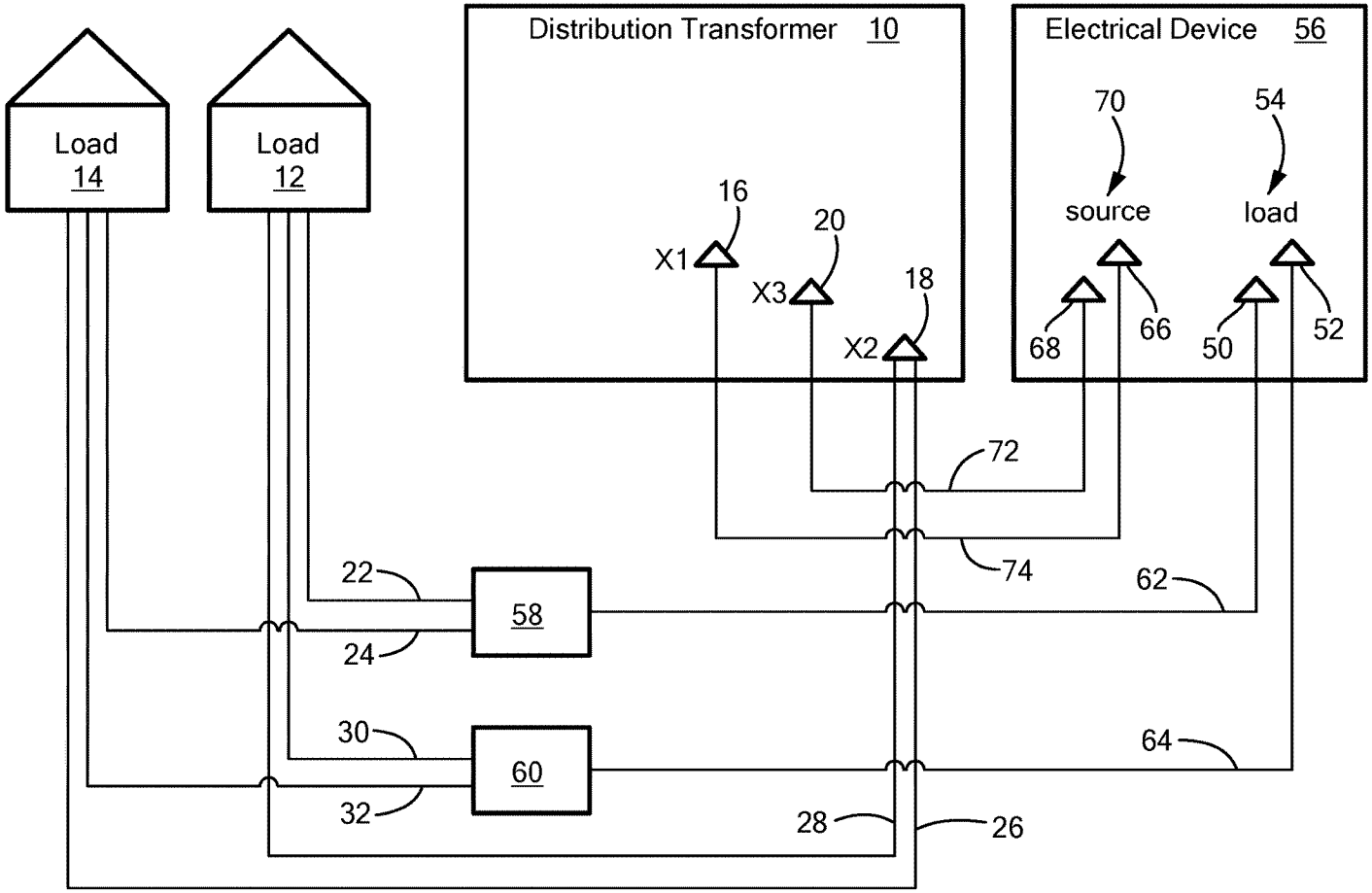
FIG. 5 PRIOR ART
FIG. 5 is a schematic block diagram showing an example of a conventional connection between a distribution transformer and one or more loads after an electrical device is introduced.

FIG. 5, where like parts include like numbers, shows one example used to provide connections from connectors 50, 52 on load side 54 of electrical device 56 to, in this example, one or more loads 12 and/or 14, using submersible secondary distribution connectors 58 and 60. In this example, submersible secondary distribution connector 58 is coupled on one side to conductor 62 coupled to load side connector 50 of electrical device 56 and on the other side to previously existing conductors 22, 24 coupled to one or more loads 12 and/or 14 as shown. Similarly, submersible secondary distribution connector 60 is coupled on one side to conductor 64 coupled to load side connector 52 and on the other side is coupled to previously existing conductors 30, 32 coupled to one or more loads 12 and/or 14 as shown. In this example, conductors 26 and 28 coupled to LV output X2-18 and one or more loads 12 and/or 14 remains the same as shown in FIG. 1. Connectors 66 and 68, FIG. 5, on source side 70 of electrical device 56 are connected to LV outputs X1-16 and X3-20, respectively as shown by conductors 72 and 74.

As discussed in the Background section above, this type of technique has several shortcomings including the complicated and time consuming installation process associated with using submersible secondary distribution connectors 58 and 60 and the new conductors to load side 54 of electrical device 56, the need to de-energize distribution transformer 10 which results in a disruption of service to one or more loads 12 and/or 14 during installation time, and submersible secondary distribution connectors 58 and 60 are typically located in a buried space below the transformer terminals. This may make it difficult to service or add any new load connections to the electrical device due to limited access and visibility of the connections as each connection is now covered with the rubber boot that encases submersible secondary distribution connectors 58 and 60. Additionally, having the electrical connections located at or below ground level may also create a risk for reliability of the connections due to exposure to water, rodents and other environmental factors. This type of connection may also make it difficult to restore the original connection between the distribution transformer and the load in case electrical device needs to be taken out of service.

In order to overcome the shortcomings discussed above, there is shown in FIG. 6, where like parts have been given like numbers, one embodiment of transformer terminal coupler 80 in close proximity to distribution transformer 10 for connecting at least one electrical device, in this example electrical device 56, to one or more loads, e.g., one or more loads 12 and/or 14. Transformer terminal coupler 80 includes at least one connection point device electrically isolated from distribution transformer 10 and physically secured in close proximity to a low voltage output of the distribution transformer. For example, transformer terminal coupler 80 may include connection point device 82 which is electrically isolated from distribution transformer 10 and physically secured in close proximity to low voltage output X1-16 of distribution transformer 10. In one design, transformer terminal coupler 80 may also include connection point device 84 electrically isolated from distribution transformer 10 and physically secured in close proximity to low voltage output X3-20 of distribution transformer 10.

Connection point device 80 and/or connection point device 84 is configured to secure electrical coupling of at least one electrical device 56 to one or more loads 12 and/or 14. In this example, connection point device 82 is electrically isolated from distribution transformer 10 and physically secured in close proximity to LV output X1-16 and secures electrical coupling of connector 50 coupled to conductor 86 on load side 54 of electrical device 56 to conductor 22 coupled to load 12 and conductor 24 coupled to load 14 in as shown. In one embodiment, transformer terminal coupler 80 preferably includes connection point device 84 electrically isolated from distribution transformer 10 and physically secured in close proximity to LV output X3-20 and secures electrical coupling of connector 52 coupled to conductor 88 on load side 54 of electrical device 56 to conductor 30 coupled to load 12 and conductor 32 coupled to load 14 as shown. As disclosed herein, close proximity means connection point device 80 and/or connection point device 84 is less than about 2 feet from distribution transformer 10. In this example, similar as discussed above with reference to FIG. 5, the connections between LV output X2-18 of distribution transformer to one or more loads 12, 14 by conductors 28 and 30 remains unchanged. Although in this example, transformer terminal coupler 80 is shown having two connection point devices 82 and 84, this is not a necessary limitation, as transformer terminal coupler 80 may have only one connection point device, e.g., one of connection point devices 82 or 84, or may have more than two connection point devices as needed. Additionally, although this example transformer terminal coupler 80 does not use a connection point device for LV output X2-18, transformer terminal coupler 80 may include a connection point device for LV output X2-18 and may or may not include a connection point device for LV outputs X1-16 and/or X3-20.

The result is transformer terminal coupler 80 with at least one connection point device 82 and/or connection point device 84 provides electrical isolation from distribution transformer 10 and is physically secured in close proximity to low voltage outputs X1-16 and X3-20 of distribution transformer 10 to provide secure electrical coupling of at least one electrical device 56 to one or more loads 12 or 14 without the need to need to use submersible secondary distribution connectors or similar type devices. Thus, transformer terminal coupler 80 provides a simple, less complicated and less expensive way to connect one or more loads to an electrical device than the techniques discussed above.

Figure 6:
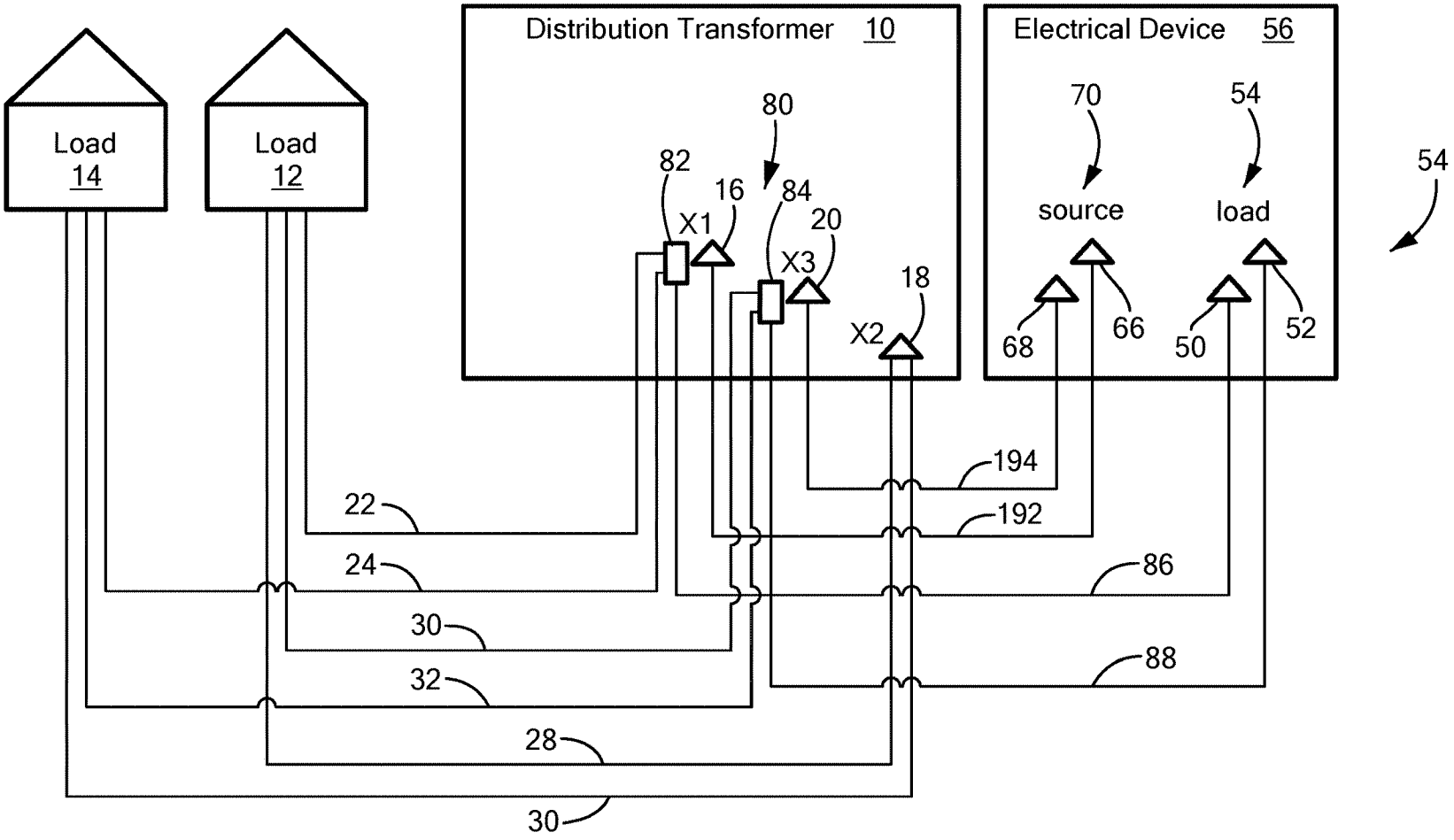
FIG. 6 is a schematic block diagram showing the primary components of one embodiment of the transformer terminal coupler in close proximity to a distribution transformer for connecting at least one electrical device to one or more loads of this invention.
Figure 7:
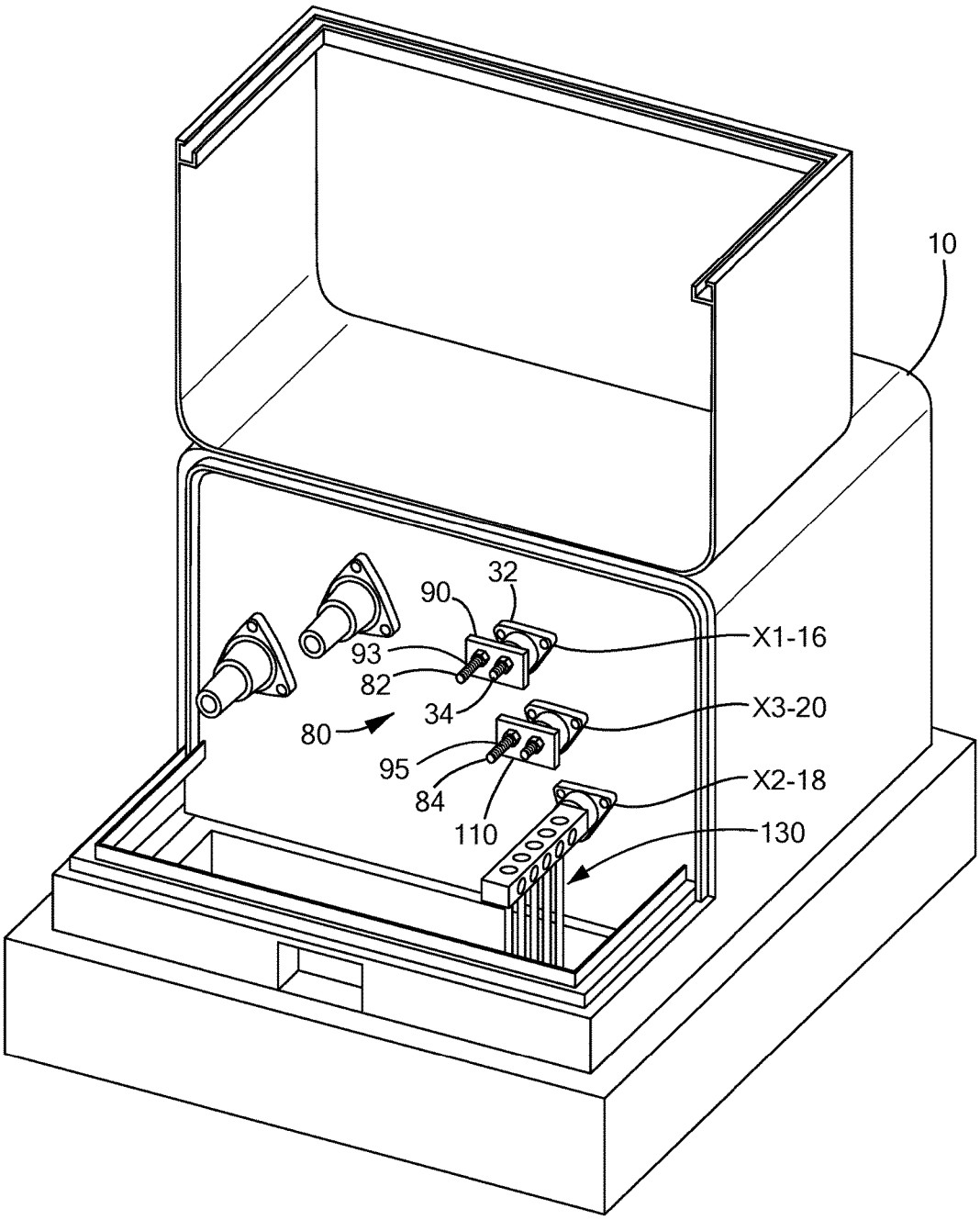
FIG. 7 shows a three-dimensional view of one embodiment of the transformer terminal coupler shown in FIG. 6 in place on a distribution transformer.
Figure 8:
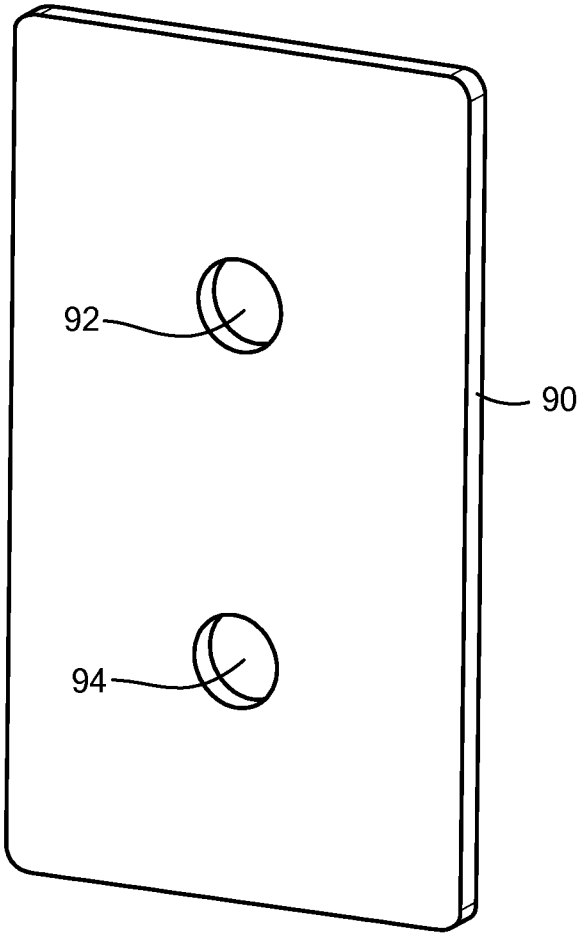
FIG. 8 is a schematic front-view showing in further detail one example of the insulator plate shown in FIG. 7.

In one design, to electrically isolate and physically secure connection point device 82 in close proximity to low voltage output X1-16 of distribution transformer 56 and to provide secure electrical coupling of the at least one electrical device 56, to the one or more loads 12 and/or 14, transformer terminal coupler 80 preferably includes insulation plate 90, FIG. 7, where like parts have been given like numbers. Insulation plate 90, shown in further detail in FIG. 8, is typically made of an insulating material, such as plastic, rubber, or similar type insulating material which electrically isolates distribution transformer 10 from connection point device 82. Insulation plate 90 preferably includes opening 92 configured to receive threaded stud 34, FIG. 7 (shown in greater detail in FIG. 3) of low voltage bushing 32, of low voltage output X1-16, FIG. 7 and opening 94, FIG. 8, configured to secure connection point device 82, FIG. 7, configured as threaded stud 93 FIG. 9, where like parts included like numbers, shows in further detail one example of insulation plate 90 coupled to LV bushing 32 with threaded stud 34 extending through opening 92 and connection point device 82 of transformer terminal coupler 80 configured as threaded stud 93 as shown and preferably coupled to insulation plate via opening 94 and secured to insulation plate 90 by nut 96. In one design, threads 98 of the threaded stud 93 of connection point device 82 preferably have the same pitch as threads 100 of threaded stud 34 of LV bushing 32 and threaded stud 93 has the same diameter, d-104, as diameter, d-106 of threaded stud 34 of LV bushing 32 coupled to each of LV outputs X1-16, FIGS. 6 and 7, X2-18 and X3-20. Such a design allow connection point device 82 to be compatible and mate with a stud-mounted terminal connector which may have been previously connected to stud 34 of LV bushing 32 of one or more of LV output X1-16, X2-18 and/or X3-20, FIGS. 6 and 7, e.g. slip-fit stud-mounted terminal connector 36, FIG. 3 or any of the threaded spade stud-mounted terminal connectors 44, FIG. 4. Similarly, connection point device 84, FIG. 7, may include insulation plate 110 having the same design as insulation plate 90 and preferably includes threaded stud 95 having the same diameter and pitch as threaded stud 34, FIG. 9 to physically secure and electrically isolate connection point device 84 in close proximity to low voltage output X3-20 of distribution transformer, as shown in FIG. 7, to provide compatibility with a stud-mounted terminal connector which may have been previously connected to stud of LV bushing of LV output X3-20, FIG. 7.

Figure 9:
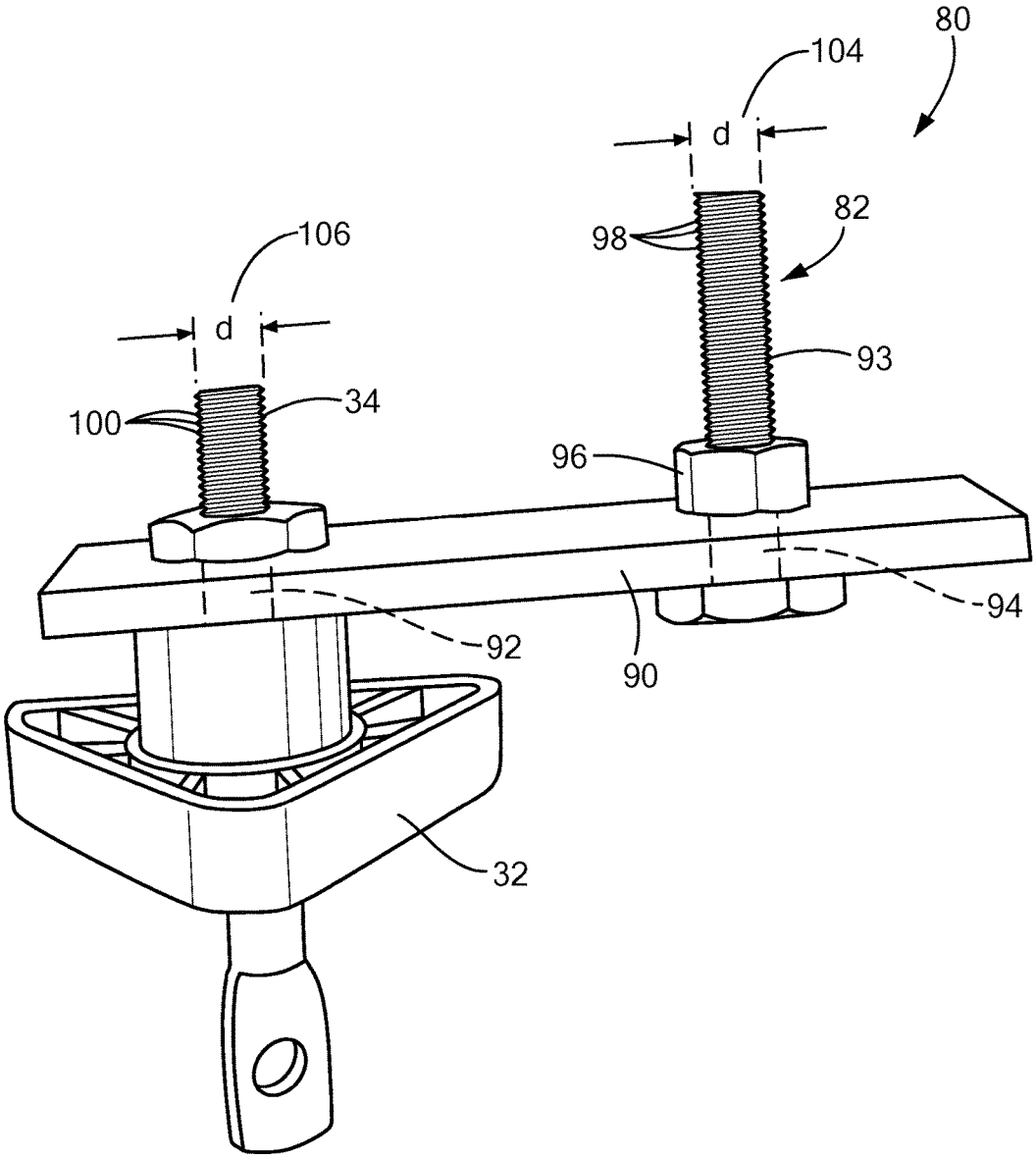
FIG. 9 is a schematic side-view showing in further detail one embodiment of the transformer terminal coupler shown in FIGS. 6 and 7.

Insulating plate 90 and/or insulation plate 110, FIGS. 7-9 allows connection point device 80 and/or connection point device 82 to be electrically isolated and physically secured in close proximity to, in this example, low voltage outputs X2-16, X3-20, FIG. 7, which may be especially useful in the absence of mounting features on distribution transformer 10, such as in the case of retrofitting an existing distribution transformer 10. Insulating plate 90 and/or insulation plate 110 each provide rigid support for connection point device 82 and/or connection point device 84, respectively, and provides a simple and easy way to secure connection points device 82 and/or connection point device 84 of transformer terminal coupler 80 to distribution transformer 10 to efficiently and effectively provide electrical isolation and physically secure in close proximity connection point device 82 and/or connection point device 84 to LV outputs X2-16 and X3-20 and secure electrical coupling of at least one electrical device 56, FIG. 6, to one or more loads 12 and/or 14. In this example shown in FIG. 7, LV output X2-18 is shown coupled to one or more loads by conductors 130. In other designs, transformer terminal coupler 80, FIG. 7, need not necessarily be connected to LV outputs X1-16 and X3-20 and may be connected to any one or more of LV outputs X1-16, X2-18 and/or X3-20, as known by those skilled in the art.

Thus, connection point device 82 and/or connection point device 84 of transformer terminal coupler 80 of this example are easily installed in close proximity to the existing LV outputs X1-16 and/or X2-20 of distribution transformer 10 to electrically isolate and physically secure connection point device 82 and/or connection point device 84 to distribution transformer 10 and secure electrical coupling electrical device 56, FIG. 6, to the one or more loads 12 and/or 14.

Figure 10:
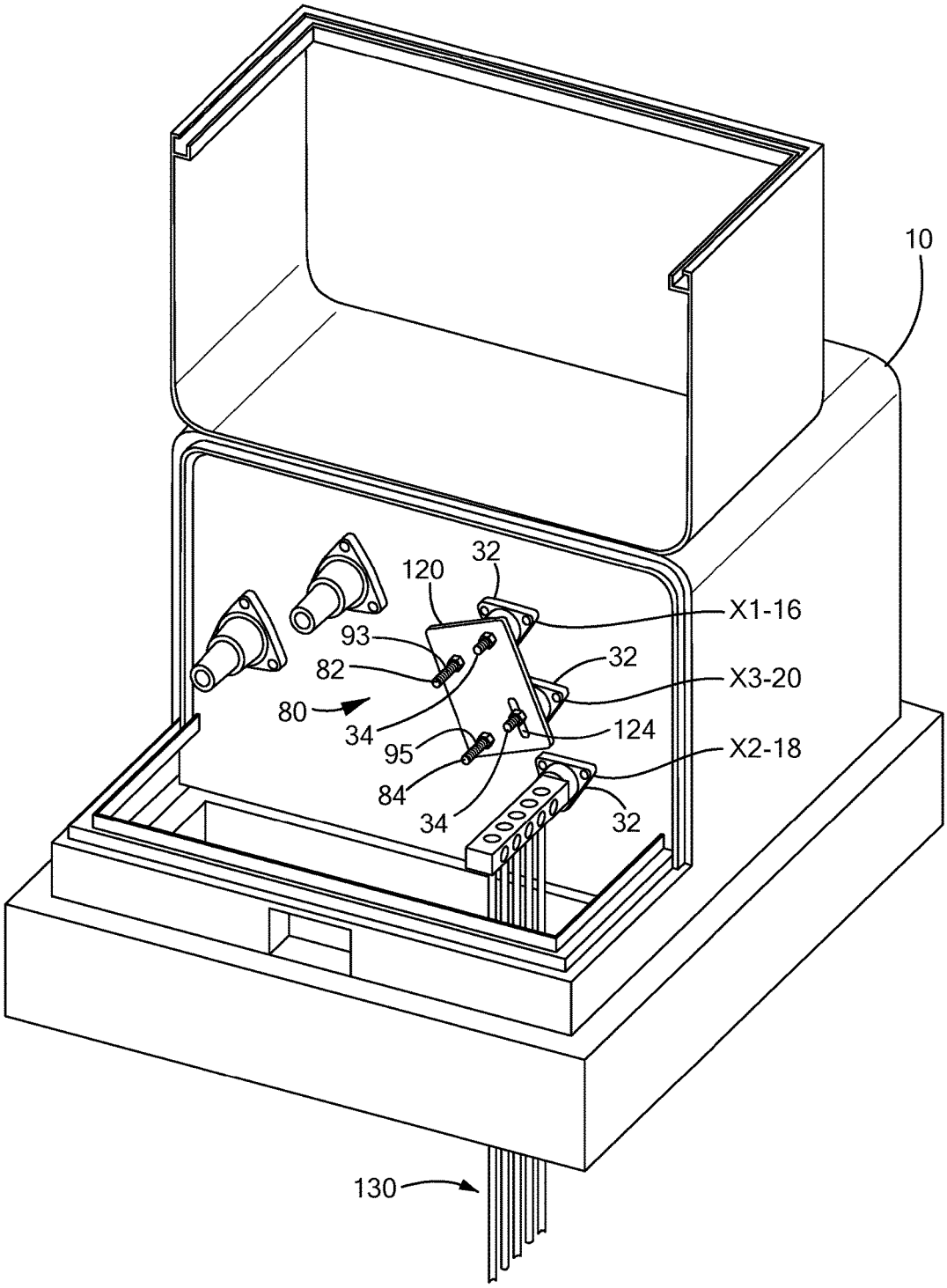
FIG. 10 shows a three-dimensional view of another embodiment of the transformer terminal coupler shown in FIG. 6 in place on a distribution transformer.
Figure 12:
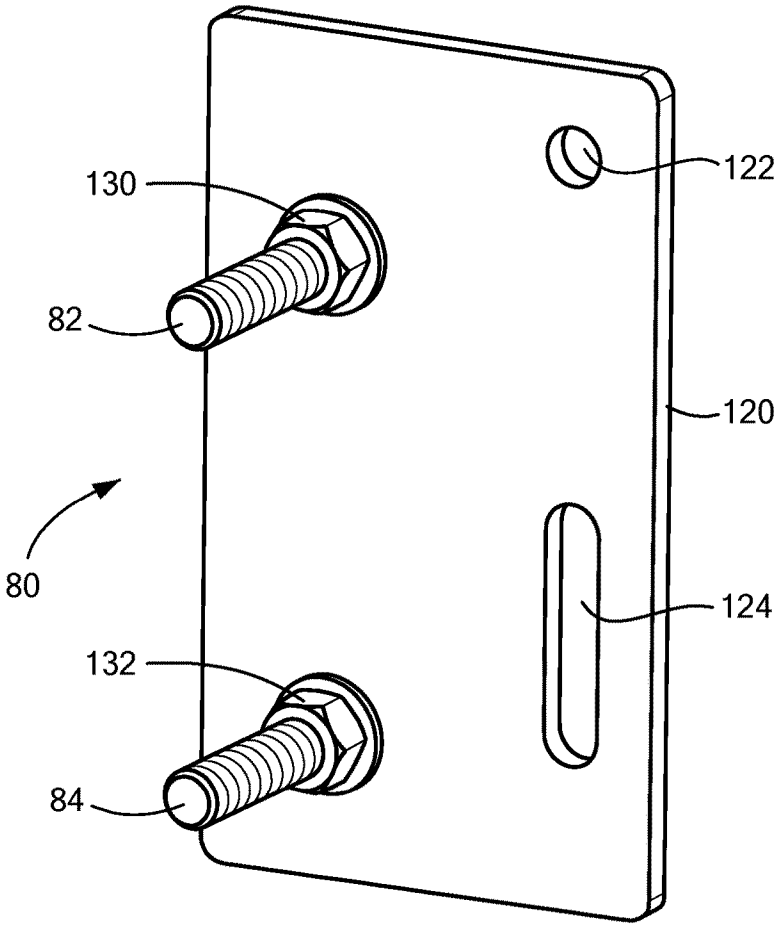
FIG. 12 is a three-dimensional front side-view showing in further detail one example of the connection point devices shown in FIG. 10 secured to the insulation plate shown in FIG. 11.
Figure 11:
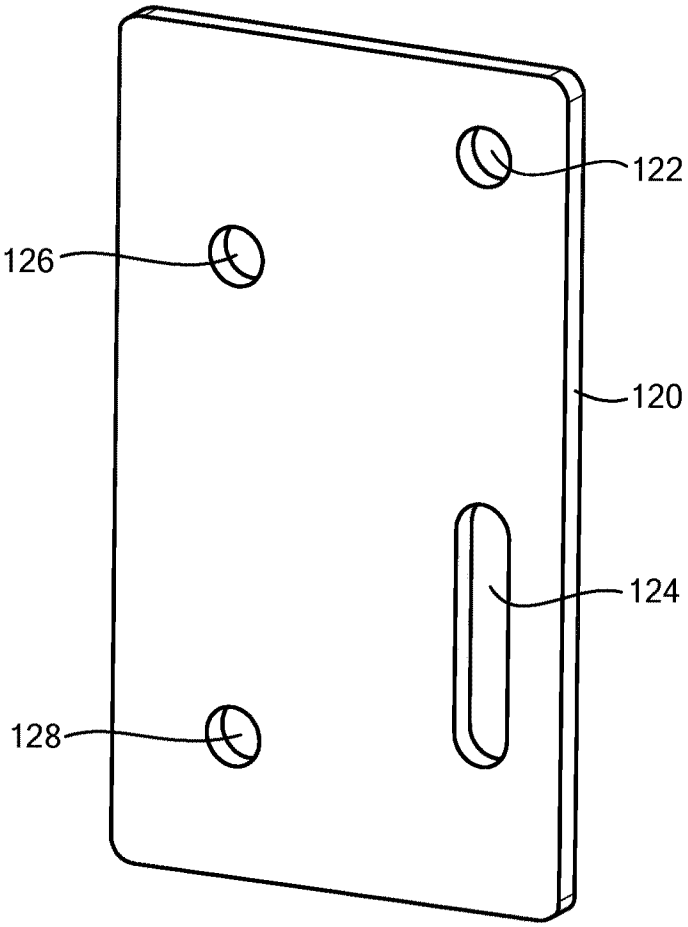
FIG. 11 is a three-dimensional front side-view showing in further detail one example of the insulation plate which may be used by the transformer coupler shown in one or more of FIGS. 6-10.

In another design, to electrically isolate and physically secure a plurality of connection point devices, e.g., connection point device 82 and connection point device 84, FIG. 6, in close proximity to LV outputs X1-16, X3-20, respectively, of distribution transformer 10 and to provide secure electrical coupling of the at least one electrical device 56 to the one or more loads 12 and/or 14, transformer terminal coupler 80, FIG. 10, where like parts have been given like numbers, preferably includes insulation plate 120 made of plastic, rubber, or similar type insulating material In this example, insulation plate 120 preferably includes opening 122, FIG. 11, configured to receive threaded stud 34, FIG. 10, of LV bushing 32 of LV output X1-16, of distribution transformer 10. Insulation plate 120 also preferably includes slotted opening 124, shown in greater detail in FIG. 11, configured to receive threaded stud 34, FIG. 10, of LV bushing 32 of LV output X3-20 of distribution transformer 10 as shown. Opening 124, FIG. 11 is preferably slotted or elongated as shown to allow for coupling of insulation plate 120 having a plurality of connection point devices 82, 84 FIG. 10, thereon to low voltage bushings 32 of LV outputs X2-16 and X3-20 which may be located in different positions for different configurations of distribution transformers 10. FIG. 12, where like parts have been given like numbers, shows in further detail one example connection point device 82 and connection point device 84 secured to insulation plate 120 at least in part by nuts 130, 132, respectively.

Insulating plate 120, FIGS. 10-12, allows connection point devices 80 and 82 to be electrically isolated and physically secured in close proximity to low voltage outputs X1-16, X3-20 which can be especially useful in the absence of mounting features on distribution transformer 10, such as in the case of retrofitting an existing distribution transformer 10. Insulating plate 120 provides rigid support for connection point devices 82 and 84 and provides a simple and easy way to secure connection points devices 82 and 84 of transformer terminal coupler 80 to distribution transformer 10 to efficiently and effectively provide electrically isolation and physically secure in close proximity connection point devices 82 and 84 to LV outputs X2-16 and X3-20 and secure electrical coupling of at least one electrical device 56, FIG. 6, to one or more loads 12 and/or 14. In the example shown in FIG. 10, LV output X2-18 is shown coupled to one or more loads by lines 130. In other designs, connection point devices 82, 82, FIG. 10, of transformer terminal coupler 80 need not necessarily be connected to LV outputs X1-16 and X3-20 and may be connected to any one or more of LV outputs X1-16, X3-20, and/or X2-18 as known by those skilled in the art.

Similar as discussed above with reference to FIGS. 7 and 9, connection point device 82, FIG. 10, may be configured as threaded stud 93 and connection point device 84 may be configured as threaded stud 95 each preferably have the same diameter and pitch the threads of stud 34 of LV bushing 32, e.g., as shown in FIG. 9.

The result is this example is connection point device 82 and connection point device 84 are easily installed in close proximity to the existing LV outputs of distribution transformer 10 to electrically isolate and physically secure connection point device 82 and connection point device 84 to distribution transformer 10 and secure electrical coupling electrical device 56, FIG. 6, to the one or more loads 12 and/or 14.

Figure 13:
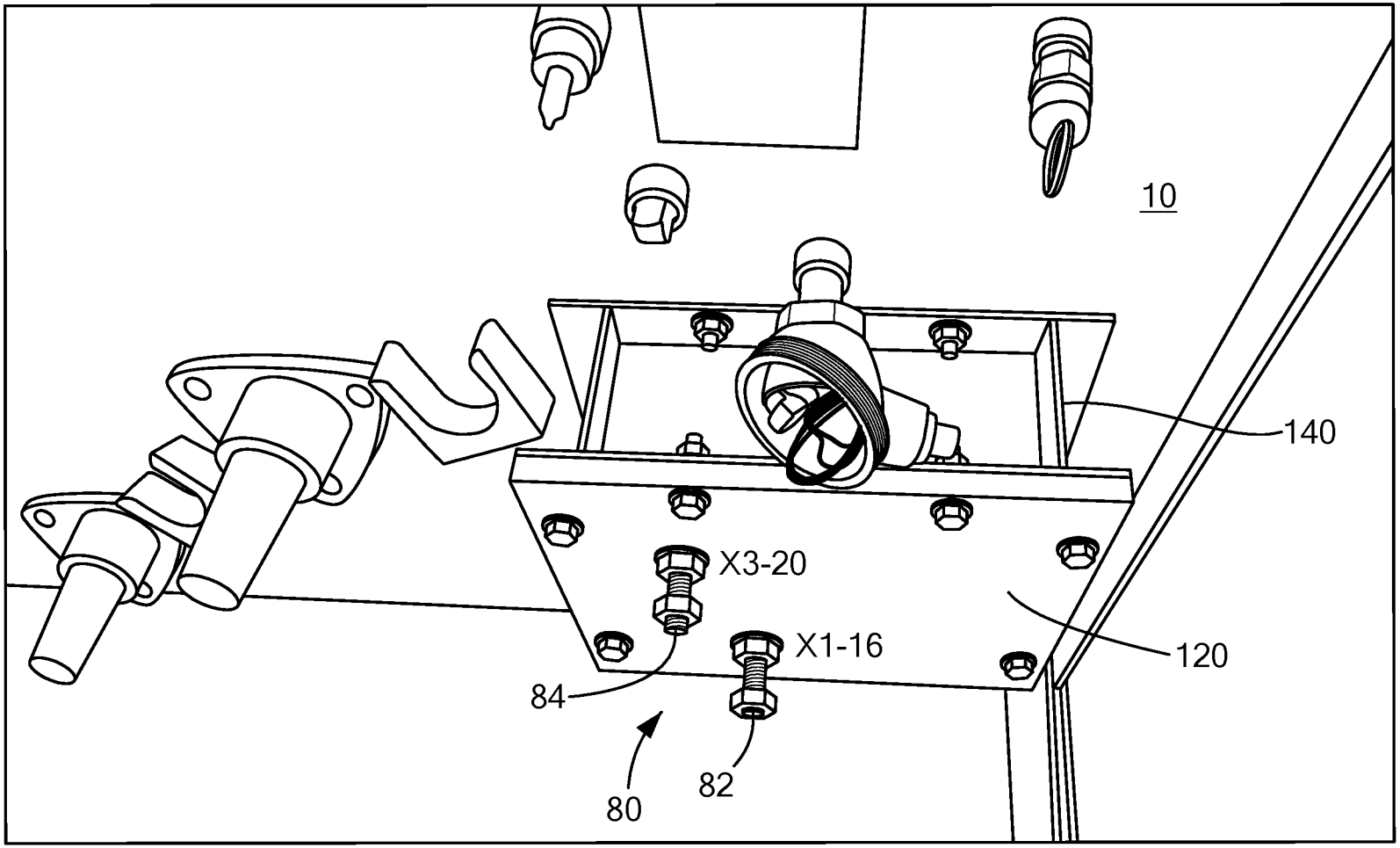
FIG. 13 is a three-dimensional top front-view showing an example of a bracket used to secure the transformer terminal coupler shown in one or more of FIGS. 6-12 to the distribution transformer.

As discussed above with reference to FIGS. 7-12, insulator plate 90, 110, FIG. 7, or insulator plate 120, FIG. 10, are shown secured to the outside of distribution transformer 10 In one example, a bracket may be utilized to secure insulator plate 90, 120, FIGS. 7-9, or insulator plate 120, FIGS. 10-12, to distribution transformer 120. For example, FIG. 13, where like parts have been given like numbers, shows an example of insulator plate 120 secured to distribution transformer 10 with bracket 140. Bracket 140 provides a simple and effective way to electrically isolate and physically secure in close proximity transformer terminal coupler 80 with connection point device 82 and/or connection point device 84 to LV outputs X1-16 and/or X3-20 of distribution transformer 10. One advantage of this example is that it may be possible to expose only the load connections if electrical device 56, FIG. 6, is already preassembled and connections between the LV outputs of the transformer and the source side of the electrical device 56 are pre-made and therefore can be hidden within the bracket 140. In this example, only load connections to one or more loads 12 and/or 14 need to be made during the insulation. It is also possible to use a transparent insulating plate to allow visual inspections of connections behind insulation plate 120.

Figure 4:
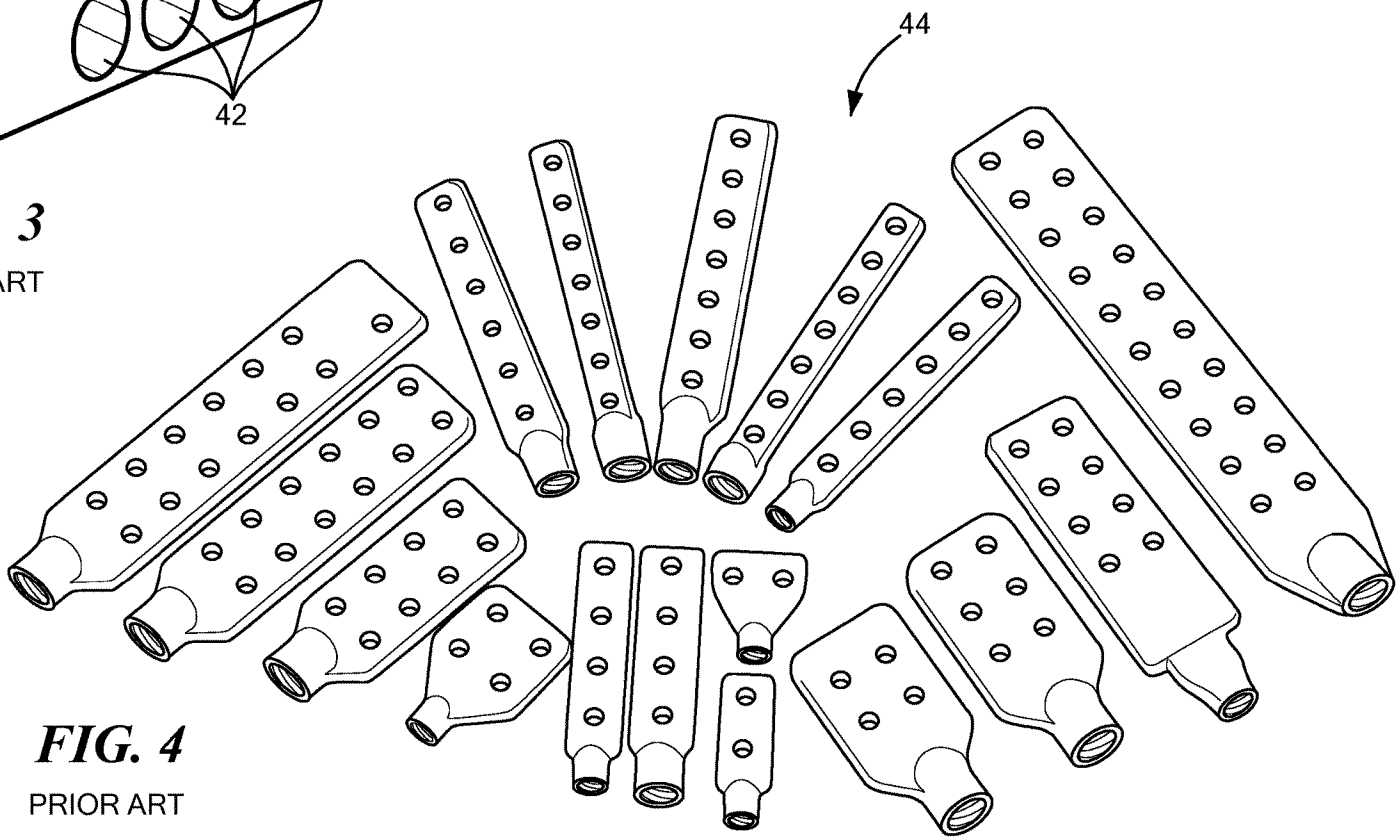
FIG. 4 PRIOR ART
FIG. 4 shows various examples of spade stud-mounted terminal connectors.

As discussed above, at least one connection point device 82 and/or connection point device 84, shown one or more of FIGS. 7-13 is/are preferably configured to mate with a stud-mounted terminal connector, such as slip-fit stud-mounted terminal connector 36 shown, FIG. 3, or any of threaded spade stud-mounted terminal connectors 44, FIG. 4.

Figure 14:
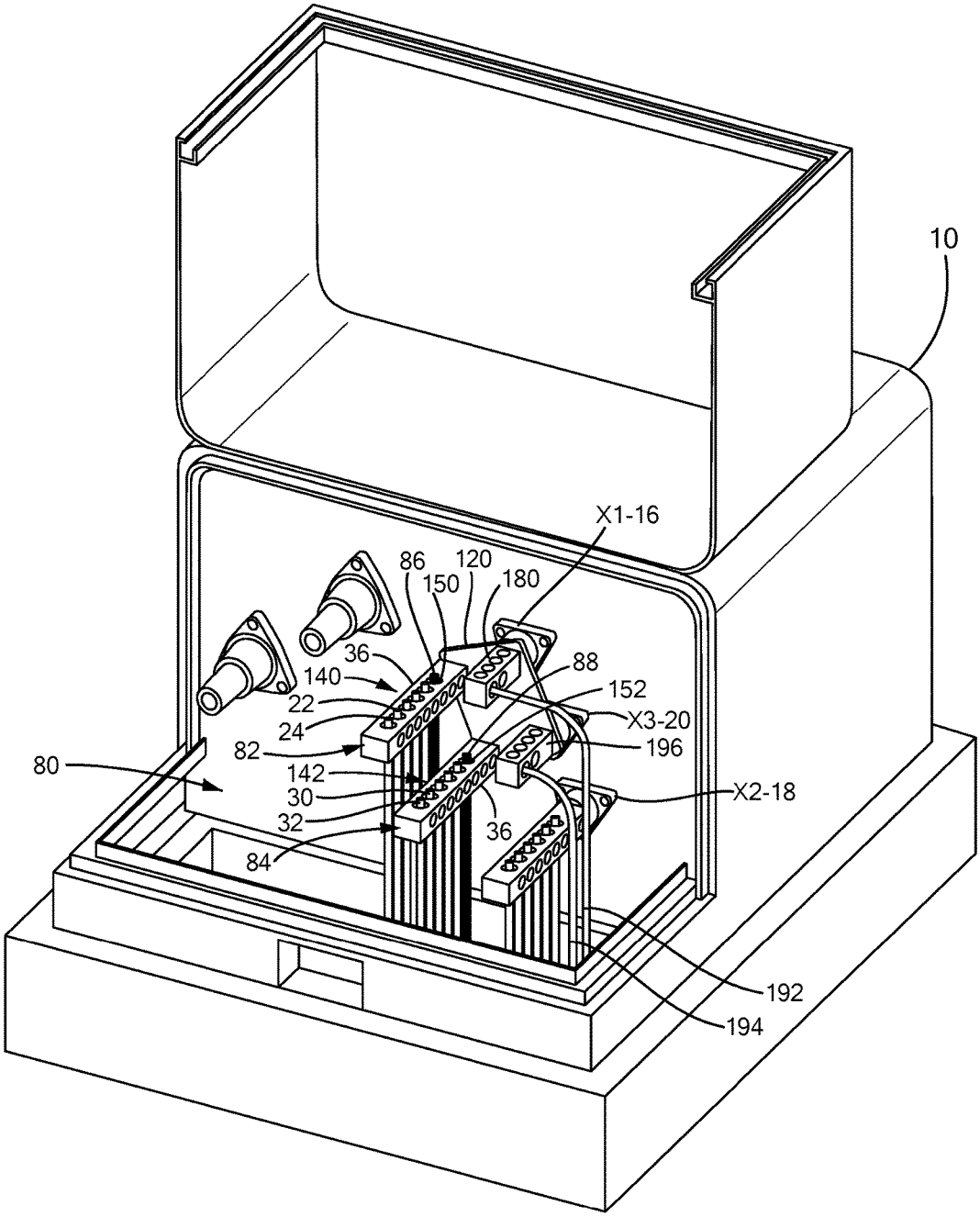
FIG. 14 is a three-dimensional view showing one embodiment of the transformer terminal coupler shown in one or more of FIGS. 6-13 with two connection point devices in place on a distribution transformer used to connect a plurality of previously connected loads to at least one electrical device.

FIG. 14, where like parts have been given like numbers, shows one example of slip-fit stud-mounted terminal connector 36 coupled to connection point device 82 in close proximity to LV output X1-16 and slip-fit, stud-mounted terminal connector 36 coupled to connection point 84 in close proximity to LV output X3-20.

In this example, slip-fit stud-mounted terminal connector 36 coupled to connection point device 82 is previously coupled to one or more loads 12 and/or 14, FIG. 6, by conductors 22 and 24, shown in place in the openings of slip-fit stud-mounted terminal connector 36, FIG. 14. In this example, additional previously coupled loads coupled to slip-fit, stud-mounted terminal connector 36 are indicated at 140. Before the electrical device is installed, the terminal connector 36 (together with all the load conductors 22, 24, 140) are electrically and physically coupled to the LV bushing of LV output X1-16. During installation of the electrical device, the load conductors 22, 24 can remain attached to the terminal connector 36, while the whole terminal connector 36 is first detached from the LV bushing of LV output X1-16, and then coupled instead to connection point device 82. As discussed above, this eliminates the need for a new submersible secondary distribution connector, since the existing terminal connector 36 may be re-used. Moreover, since the connection point device 82 is in close proximity to the LV output X1-16, the physical lengths of the load conductors 22, 24 do not need to change, e.g., cut backs are not necessary. Thus, transformer terminal coupler 80, by providing a connection point device 82 electrically isolated from the transformer and in close proximity to the LV output X1-16, enables a faster and less expensive installation process. Moreover, the final configuration shown in FIG. 14 is very similar to the configuration before the electrical device is introduced, when the terminal connector 36 is coupled directly to the LV bushing of LV output X1-16. This makes the final configuration familiar to maintenance and engineering crew and may allow for easier access, inspection and maintenance. Similarly, slip-fit stud-mounted terminal connector 36 coupled to connection point device 84 in close proximity to LV output X3-20 is coupled to one or more loads 12 and/or 14, FIG. 6, by conductors 30, 32, shown in place in the openings of slip-fit stud-mounted terminal connector 36, FIG. 14. In this example, additional previously coupled loads coupled to slip-fit, stud-mounted terminal connector 36 are indicated at 142. Similarly, the transformer terminal coupler 80, by providing a connection point device 84 electrically isolated from the transformer and in close proximity to the LV output X3-20 enables a faster and less expensive installation process which involves moving the entire terminal connector 36 previously coupled to the load conductors 30, 32, 142, and may allow for easier access, inspection and maintenance after installation.

In this example, slip-fit, stud-mounted terminal connector 36 coupled to connection point device 82 includes an opening or open port, e.g., open port 150, which enables slip-fit stud-mounted terminal connector 36 coupled to connection point device 82 to secure electrical couplings to connector 50, FIG. 6, on load side 54 of electrical device 56 to conductor 86 as shown in place in open port 150, FIG. 14. In this example, the combination of connection point device 82 with slip-fit stud-mounted terminal connector 36 having conductor 86 coupled to load side 54, FIG. 6, of electrical device 56 and conductors 22 and 24, shown in place in the opening of slip-fit stud-mounted terminal connector 36, FIG. 14, secure electrical coupling of electrical device 56, FIG. 6, to one or more loads 12 and/or 14.

Similarly, slip-fit, stud-mounted terminal connector 36 is previously coupled to one or more loads 12 and/or 14, FIG. 6, by conductors 30, 32 shown in place in the openings of slip-fit, stud-mounted terminal connector 36, FIG. 14. In this example, slip-fit stud-mounted terminal connector 36 coupled to connection point device 84 in close proximity to LV output X3-20, includes an opening or open port, e.g., open port 152, which enables slip-fit stud-mounted terminal connector 36 to secure electrical couplings to connector 52, FIG. 6, on load side 54 of electrical device 56 to conductor 88 coupled to connection point device 84. In this example, the combination of connection point device 84 with slip-fit stud-mounted terminal connector 36 having conductor 88 coupled to load side 54, FIG. 6, of electrical device 56 and conductors 30 and 32, shown in place in the opening of slip-fit stud-mounted terminal connector 36, FIG. 14, secure electrical coupling of electrical device 56, FIG. 6, to one or more loads 12 and/or 14.

Figure 15:
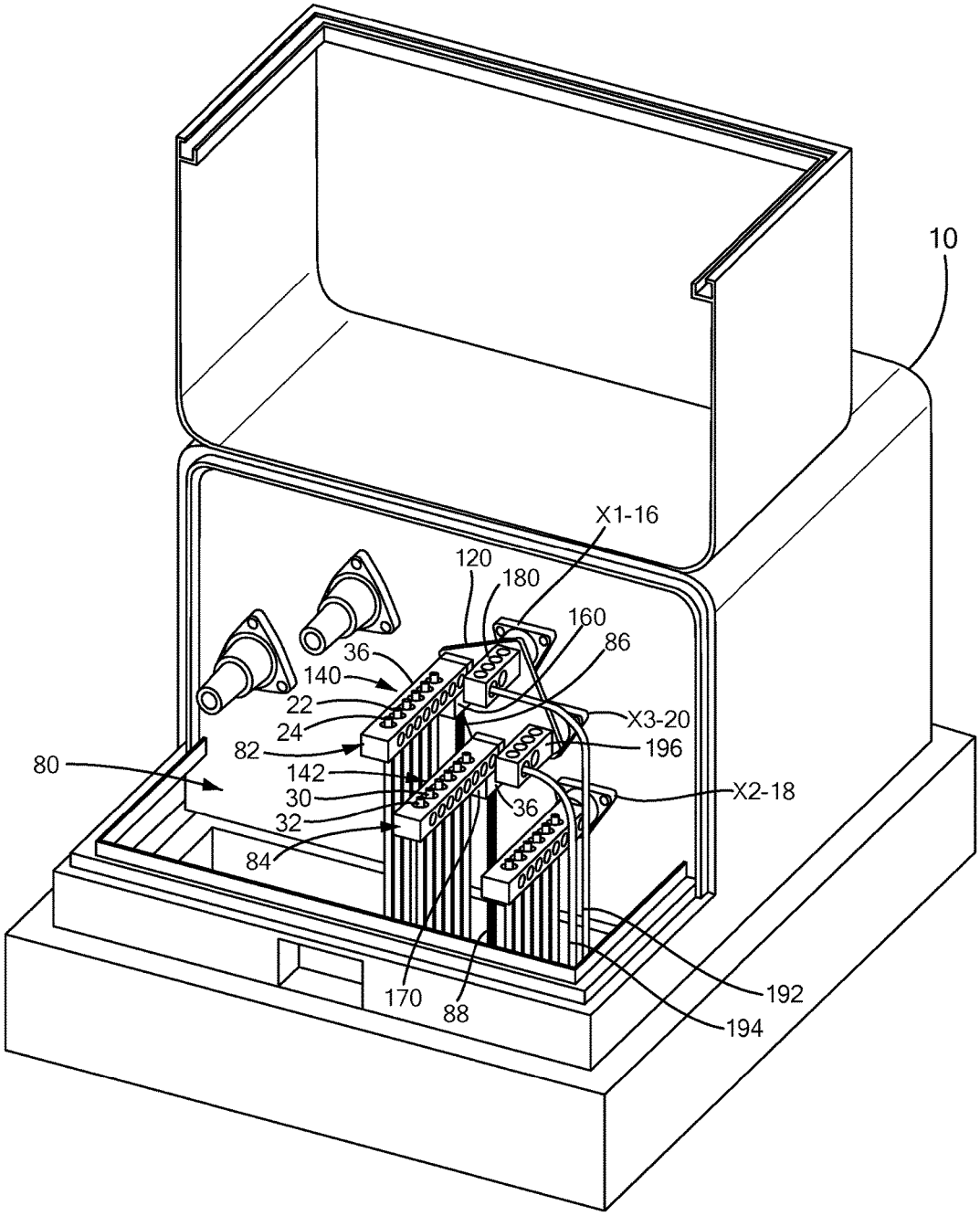
FIG. 15 is a three-dimensional view showing another embodiment of the transformer terminal coupler shown in or more of FIGS. 6-13 with two connection point devices in place on a distribution transformer used to connect a plurality of previously connected loads to at least one electrical device.
Figure 16:
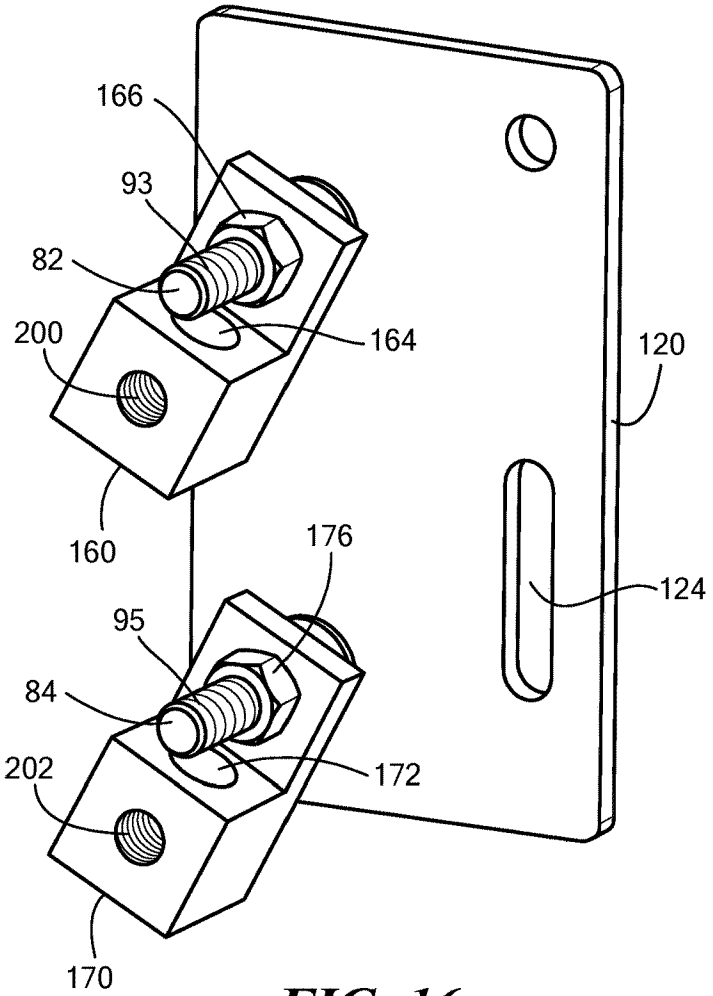
FIG. 16 is a three-dimensional view showing in further detail one example of the conductor blocks shown in FIG. 15 used to connect the load side of the at least one electrical device to one or more loads of the transformer terminal coupler shown in or more of FIGS. 6-15.

In other example, when an open port on slip-fit stud-mounted terminal connector 36, FIG. 14 is not available, transformer terminal coupler 80, FIG. 15, where like parts have been given like numbers, includes conductor block 160 coupled to connection point device 82 as shown. Conductor block 160 preferably includes at least one opening 164, FIG. 16, which enables connection point device 82, FIG. 15, to secure electrical coupling of at least one electrical device 56, FIG. 6, to one or more loads 12, 14 by conductor 86 coupled to connector 50 on load side 54 of electrical device 56, e.g., as shown by conductor 86, FIG. 15, secured in place to conductor block 160. Conductor block 164, FIG. 16, is typically secured to connection point device 82 via nut 166 which is threaded over connection point device 82 configured as threaded stud 93. A set screws is typically inserted into opening 200 to secure conductor 86 to conductor block 160.

Similarly, transformer terminal coupler 80, FIG. 15, where like parts have been given like numbers, includes conductor block 170 which is coupled to connection point device 84 as shown and has at least one opening 172, FIG. 16, which enables connection point device 84, FIG. 15, to secure electrical coupling of at least one electrical device 56, FIG. 6, to one or more loads 12, 14 by conductor 88 coupled to connector 52 on load side 54 of electrical device 56, as shown by conductor 88, FIG. 15, secured in place to conductor block 170. Conductor block 170, FIG. 16, is typically secured to connection point device 84 via nut 176 which is threaded over connection point device 84 configured as threaded stud 93. A set screws is typically inserted into opening 202 to secure conductor 88 to conductor block 170, as shown in FIG. 15.

Figure 17:
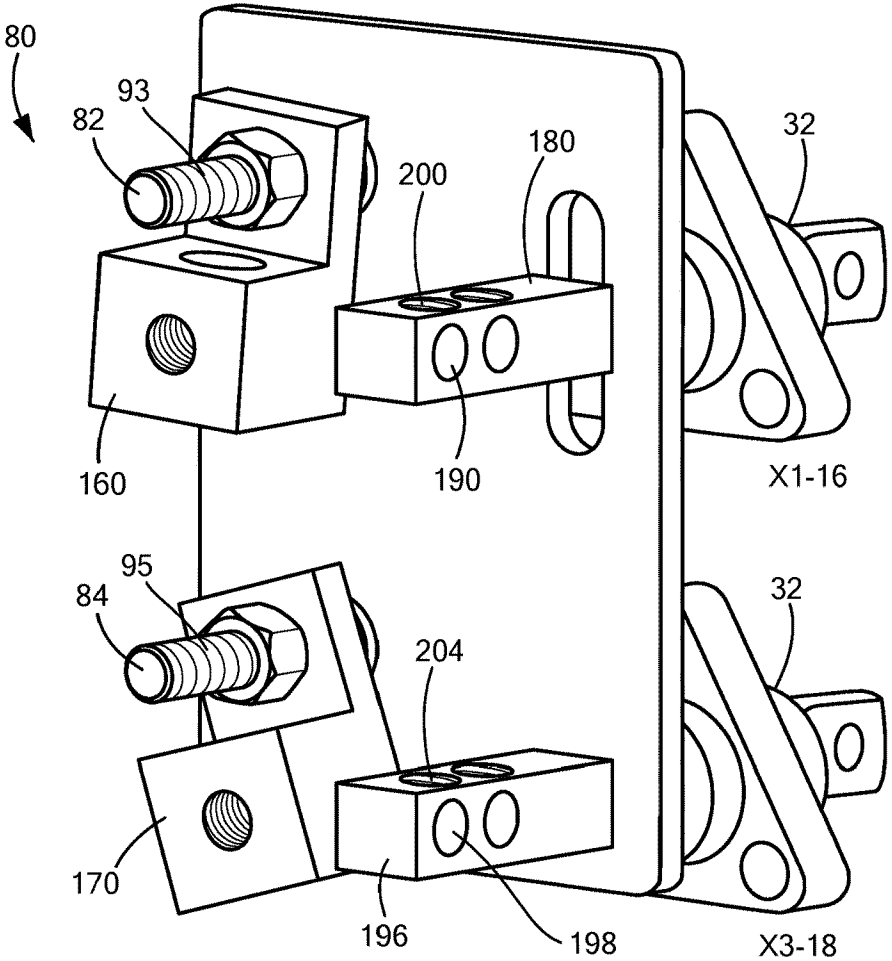
FIG. 17 is a three-dimensional front-view showing one example of a distribution transformer connector used to connect the source side of the electrical device to the distribution transformer of the transformer terminal coupler shown in or more of FIGS. 6-15.

Transformer terminal coupler 80, FIGS. 14 and 15, also preferably includes distribution transformer connector 180 configured to couple at least one low voltage output of distribution transformer 10 to at least one electrical device 56, FIG. 6. In this example, distribution transformer connector 180, FIGS. 14 and 15, is configured to couple low voltage output X1-16 of distribution transformer 10 to conductor 192 coupled to connector 66, FIG. 6, on source side 70 of electrical device 56. In one example, distribution transformer connector 180 includes at least one opening 190, FIG. 17, configured to receive conductor 192 and threaded opening 200 configured to receive a set screw to secure conductor 192 to distribution transformer connector 180, as shown in FIGS. 14 and 15.

Similarly, transformer terminal coupler 80, FIGS. 14 and 15, also preferably includes distribution transformer connector 196 configured to couple at least one low voltage output of distribution transformer 10 to at least one electrical device 56, FIG. 6. In this example, distribution transformer connector 196, FIGS. 14 and 15, is configured to couple low voltage output X3-20 of distribution transformer 10 to conductor 194 coupled to connector 68, FIG. 6, on source side 70 of electrical device 56. In one example, distribution transformer connector 196, FIGS. 14 and 15, includes at least one opening 202, FIG. 17, configured to receive conductor 194 and threaded opening 204 configured to receive a set screw to secure conductor 194 to connector 196, e.g., as shown in FIGS. 14 and 15.

Figure 18:
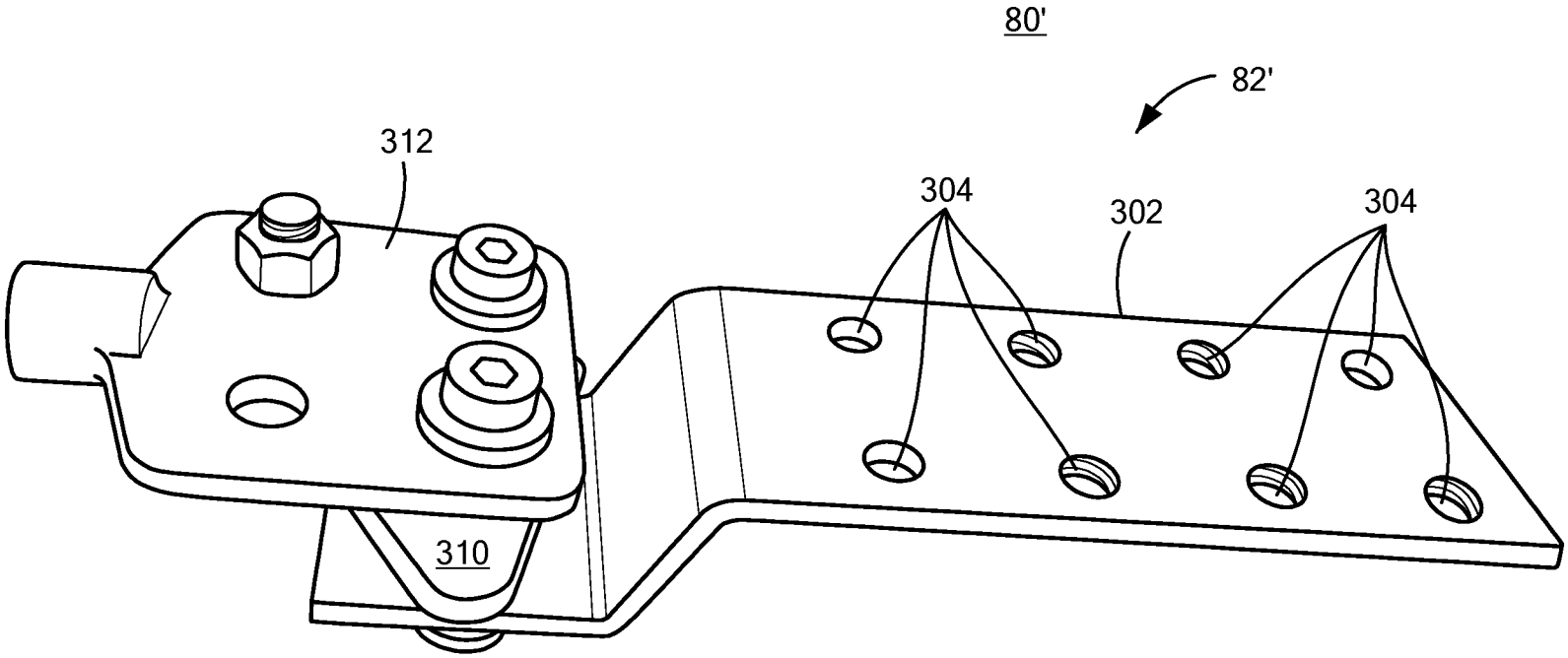
FIG. 18 is a three-dimensional side-view showing the primary components of another embodiment of the transformer terminal coupler in close proximity to a distribution transformer for connecting at least one electrical device to one or more loads of this invention.

In another embodiment, transformer terminal coupler 80', FIG. 18, may include connection point device 82' in close proximity to distribution transformer 10, FIG. 6, for connecting at least one electrical device 56 to one or more loads, e.g., one or more loads 12 and/or 14. In the example connection point device 82' is preferably configured as conductor block 302 with at least one opening therein, e.g., any one of the openings indicated at 304, that enables at least one connection point device 82' to secure electrical coupling of at least one electrical device 56, FIG. 6, to one or more loads 12 and/or 14. Preferably, conductor block 302 is configured to resemble a spade terminal connector, FIG. 4, to allow similar connection means for attaching conductors 22, 24 and 86, FIG. 6 and/or conductors 30, 32 and 88, known by those skilled in the art. In this example, transformer terminal coupler 80' includes insulator 310 physically coupled to at least one connection point device 82' and is configured to electrically isolate at least one connection point device 82' from distribution transformer 10. In this example, connection point device 82' is electrically isolated from spade mounted terminal 312 which is coupled to low voltage output of distribution transformers 10, e.g., one or more LV outputs X1-16, X2-18 and/or X3-20.

Figure 19A:
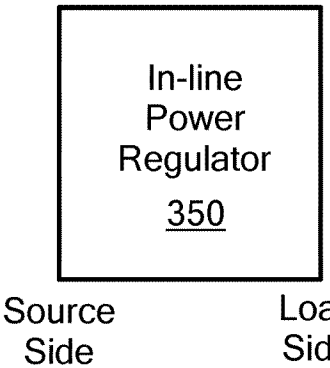
FIGS. 19A-19E show various examples of the at least one electrical device shown in one or more of FIGS. 6-18.
Figure 19B:
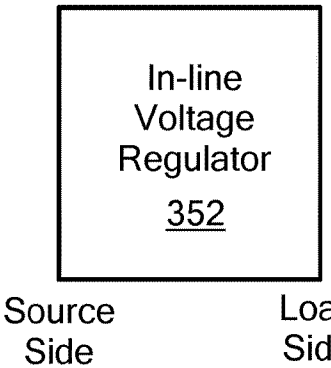
Figure 19C:
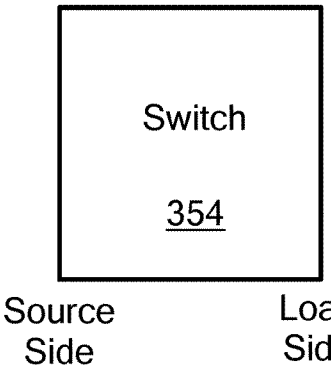
Figure 19D:
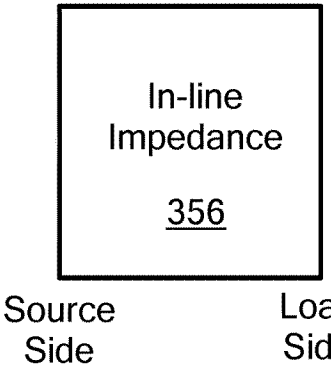
Figure 19E:
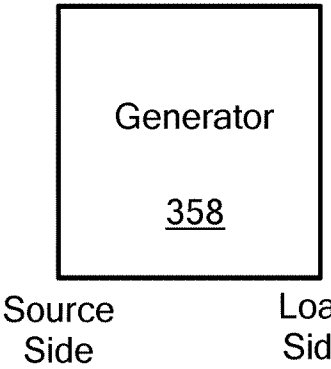

In one example, at least one electrical device 56, FIG. 6, may include in-line power regulator 350, FIG. 19A, in-line voltage regulator 352, FIG. 19B, switch 354, FIG. 19C, in-line impedance 356, FIG. 19D, or generator 358, FIG. 19E.

Although specific features of the invention are shown in sonic drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant cannot be expected to describe certain insubstantial substitutes for any claim element amended.

What is claimed is:

1. A transformer terminal coupler in close proximity to a distribution transformer for connecting at least one electrical device to one or more loads, the transformer terminal coupler comprising:

at least one connection point device electrically isolated from the distribution transformer and physically secured in close proximity to a low voltage output of the distribution transformer; and the at least one connection point device configured to secure electrical coupling of the at least one electrical device to the one or more loads.

2. The transformer terminal coupler of claim 1 in which the at least one connection point device is configured to secure electrical coupling of a load side of the at least one electrical device to the one or more loads.

3. The transformer terminal coupler of claim 1 in which the at least one connection point device is configured to mate with a stud-mounted terminal connector.

4. The transformer terminal coupler of claim 3 in which the stud-mounted terminal connector is previously coupled to at least one of the one or more loads.

5. The transformer terminal coupler of claim 4 in which the stud-mounted terminal connector includes an open port that enables the at least one connection point device to secure electrical coupling of the at least one electrical device to the one or more loads.

6. The transformer terminal coupler of claim 3 in which the at least one connection point device includes a stud configured to mate with the stud-mounted terminal connector.

7. The transformer terminal coupler of claim 6 in which the stud is configured to have a compatible size of a stud of a low voltage bushing of the distribution transformer.

8. The transformer terminal coupler of claim 7 in which the stud is configured to have the same diameter and threads of the same pitch as the stud of the low voltage bushing of the distribution transformer.

9. The transformer terminal coupler of claim 6 in which the at least one connection point device includes a lug connector.

10. The transformer terminal coupler of claim 3 in which the stud-mounted terminal connector includes a slip-fit stud-mounted terminal connector.

11. The transformer terminal coupler of claim 3 in which the stud-mounted terminal connector includes a threaded stud-mounted terminal connector.

12. The transformer terminal coupler of claim 3 in which the stud-mounted terminal connector includes a set screw.

13. The transformer terminal coupler of claim 3 in which the stud-mounted terminal connector includes a spade stud-mounted terminal connector.

14. The transformer terminal coupler of claim 1 in which the at least one connection point device is configured to couple directly with at least one load.

15. The transformer terminal coupler of claim 14 in which the connection point device includes a conductor block with at least one opening therein that enables the at least one connection point device to secure electrical coupling of the at least one electrical device to the one or more loads.

16. The transformer terminal coupler of claim 15 in which the connector block includes at least one set screw.

17. The transformer terminal coupler of claim 1 further including an insulator physically coupled to the at least one connection point device and configured to electrically isolate the at least one connection point device from the distribution transformer.

18. The transformer terminal coupler of claim 17 in which the insulator is secured to an outside of the distribution transformer.

19. The transformer terminal coupler of claim 18 in which the insulator is secured to at least one low voltage output of the distribution transformer.

20. The transformer terminal coupler of claim 18 further including a bracket coupled to the distribution transformer configured to secure the insulator to the distribution transformer.

21. The transformer terminal coupler of claim 17 in which the insulator is configured as a plate of insulation material.

22. The transformer terminal coupler of claim 21 in which the plate of insulation material includes at least one opening.

23. The transformer terminal coupler of claim 22 in which a stud of a low voltage bushing of the distribution transformer extends through an opening of the plate of insulation material.

24. The transformer terminal coupler of claim 22 in which the plate of insulation material includes at least one slotted opening.

25. The transformer terminal coupler of claim 17 in which the insulator is configured as a block of insulation material.

26. The transformer terminal coupler of claim 1 further including a distribution transformer connector configured to couple the at least one low voltage output of the distribution transformer to the at least one electrical device.

27. The transformer terminal coupler of claim 26 in which the distribution transformer connector is configured to couple the at least one low voltage output of the distribution transformer to a source-side of the at least one electrical device.

28. The transformer terminal coupler of claim 26 in which the distribution transformer connector includes a stud-mounted terminal connector configured to mate with a stud of a low voltage bushing of the distribution transformer.

29. The transformer terminal coupler of claim 28 in which the stud-mounted terminal connector includes a slip-fit stud-mounted terminal connector.

30. The transformer terminal coupler of claim 28 in which the stud-mounted terminal connector includes a threaded stud-mounted terminal connector.

31. The transformer terminal coupler of claim 28 in which the stud-mounted terminal connector includes a set screw.

32. The transformer terminal coupler of claim 28 in which the stud-mounted terminal connector includes a spade stud-mounted terminal connector.

33. The transformer terminal coupler of claim 1 in which the at least one electrical device includes one or more of: an in-line power regulator, an in-line voltage regulator, a switch, an in-line impedance, and a generator.

34. The transformer terminal coupler of claim 17 in which the at least one connection point device is configured to mate with a stud-mounted terminal connector.

35. The transformer terminal coupler of claim 17 further including a distribution transformer connector configured to couple at least one low voltage output of the distribution transformer to the at least one electrical device.

36. The transformer terminal coupler of claim 26 in which the distribution transformer connector includes a spade stud-mounted terminal connector.

37. The transformer terminal coupler of claim 36 in which the at least one connection point device is configured to couple directly with at least one load.

38. The transformer terminal coupler of claim 37 in which the at least one connection point device includes a conductor block with at least one opening therein that enables the at least one connection point device to secure electrical coupling of the at least one electrical device to the one or more loads.

39. The transformer terminal coupler of claim 38 in which the spade stud-mounted terminal connector includes at least one opening configured to couple the low voltage output of the distribution transformer to a source side of the at least one electrical device.

40. A transformer terminal coupler in close proximity to a distribution transformer for connecting at least one electrical device to one or more loads, the transformer terminal coupler comprising:

at least one connection point device configured to mate with a stud-mounted terminal connector, the at least one connection point device electrically isolated from the distribution transformer and physically secured in close proximity to a low voltage output of the distribution transformer;

an insulator physically coupled to the at least one connection point device configured to electrically isolate the at least one connection point device from the distribution transformer: and the at least one connection point device configured to secure electrical coupling of the at least one electrical device to the one or more loads.

41. A transformer terminal coupler in close proximity to a distribution transformer for connecting at least one electrical device to one or more loads, the transformer terminal coupler comprising:

at least one connection point device electrically isolated from the distribution transformer and physically secured in close proximity to a low voltage output of the distribution transformer;

an insulator physically coupled to the at least one connection point device and configured to electrically isolate the at least one connection point device from the distribution transformer;

a distribution transformer connector coupled to the insulator and configured to couple the at least one low voltage output of the distribution transformer to a source-side of the at least one electrical device; and the at least one connection point device configured to secure electrical coupling of the at least one electrical device to the one or more loads.

42. A transformer terminal coupler in close proximity to a distribution transformer for connecting at least one electrical device to one or more loads, the transformer terminal coupler comprising:

at least one connection point device electrically isolated from the distribution transformer and physically secured in close proximity to a low voltage output of the distribution transformer;

an insulator physically coupled between the at least one connection point device and a spade stud-mounted terminal connector coupled to the low voltage output of the distribution transformer, the insulator configured to electrically isolate the at least one connection point device from the distribution transformer;

the at least one connection point device including a conductor block coupled to the insulator with at least one opening therein configured to secure electrical coupling of the at least one electrical device to the one or more loads device; and the spade stud-mounted terminal connector including at least one opening configured to couple the low voltage output of the distribution transformer to a source-side of the at least one electrical device.

43. A transformer terminal coupler in close proximity to a distribution transformer for connecting at least one electrical device to one or more loads, the transformer terminal coupler comprising:

a plurality of connection point devices each electrically isolated from the distribution transformer and each physically secured in close proximity to a low voltage output of the distribution transformer; and each of the plurality of connection point devices configured to secure electrical coupling of the at least one electrical device to the one or more loads.

44. The transformer terminal coupler of claim 43 in which each of the plurality of connection point devices is configured to connect a load side of the at least one electrical device to one or more loads.

45. The transformer terminal coupler of claim 43 in which each of the plurality of connection point devices is configured to mate with a stud-mounted terminal connector.

46. The transformer terminal coupler of claim 45 in which the stud-mounted terminal connector is previously coupled to at least one of the one or more loads.

47. The transformer terminal coupler of claim 45 in which the stud-mounted terminal connector includes an open port that enables the at least one connection point device to secure electrical coupling of the at least one electrical device to the one or more loads.

48. The transformer terminal coupler of claim 43 in which each of the plurality of connection point devices includes a stud configured to mate with a stud-mounted terminal connector.

49. The transformer terminal coupler of claim 48 in which each stud is configured to have a compatible size of a stud of a low voltage bushing of the distribution transformer.

50. The transformer terminal coupler of claim 49 in which each stud is configured to have a same diameter and threads of the same pitch as the stud of the low voltage bushing of the distribution transformer.

51. The transformer terminal coupler of claim 43 in which at least one of the plurality of connection point devices includes a lug connector.

52. The transformer terminal coupler of claim 43 further including an insulator physically coupled to the plurality of connection point devices and configured to electrically isolate the plurality of connection point devices from the distribution transformer.

53. The transformer terminal coupler of claim 52 in which the insulator is secured to an outside of the distribution transformer.

54. The transformer terminal coupler of claim 53 in which the insulator is secured to the plurality of connection point devices and a plurality of low voltage outputs of the distribution transformer.

55. The transformer terminal coupler of claim 53 further including a bracket coupled to the distribution transformer configured to secure the insulator to the distribution transformer.

56. The transformer terminal coupler of claim 52 in which the insulator is configured as a plate of insulation material.

57. The transformer terminal coupler of claim 56 in which the plate of insulation material includes a plurality of openings.

58. The transformer terminal coupler of claim 57 in which studs of low voltage bushings of the distribution transformer extend through the openings.

59. The transformer terminal coupler of claim 56 in which the plurality of openings include at least one slotted opening.

60. The transformer terminal coupler of claim 43 further including a plurality of distribution transformer connectors each configured to couple a low voltage output of the distribution transformer to the at least one electrical device.

61. The transformer terminal coupler of claim 60 in which each of the plurality of distribution transformer connectors is configured to couple a low voltage output of the distribution transformer to a source-side of the at least one electrical device.

62. The transformer terminal coupler of claim 60 in which each of the plurality of distribution transformer connectors includes a stud-mounted terminal connector configured to mate with a stud of a low voltage bushing of the distribution transformer.

63. The transformer terminal coupler of claim 43 in which the at least one electrical device includes one or more of: an in-line power regulator, an in-line voltage regulator, a switch, an in-line impedance, and a generator.

64. The transformer terminal coupler of claim 52 in which each of the plurality of connector point devices is configured to mate with a stud-mounted terminal connector.

65. The transformer terminal coupler of claim 52 further including a plurality of distribution transformer connectors each configured to couple a low voltage output of the distribution transformer to the at least one electrical device.

* * * * *